US006474321B1

(12) United States Patent
Suckewer et al.

(10) Patent No.: US 6,474,321 B1
(45) Date of Patent: Nov. 5, 2002

(54) LONG-LIFE TRAVELING SPARK IGNITOR AND ASSOCIATED FIRING CIRCUITRY

(75) Inventors: Syzmon Suckewer; Artur P. Suckewer; Gunter Schemmann, all of Princeton, NJ (US)

(73) Assignee: Knite, Inc., Monmouth, NJ (US)

( * ) Notice: Subject to any disclaimer, the term of this patent is extended or adjusted under 35 U.S.C. 154(b) by 0 days.

(21) Appl. No.: 09/595,703

(22) Filed: Jun. 16, 2000

Related U.S. Application Data

(60) Provisional application No. 60/155,691, filed on Sep. 15, 1999.

(51) Int. Cl.[7] ..... F02P 3/02; F02P 23/00

(52) U.S. Cl. ..... 123/620; 123/143 B

(58) Field of Search ..... 123/143 B, 143 R, 123/169 R, 169 EL, 169 E, 620, 640; 315/209 M; 313/130, 131 R, 141, 142

(56) References Cited

U.S. PATENT DOCUMENTS

| | | | | |
|---|---|---|---|---|
| 3,413,518 A | | 11/1968 | Chafer et al. | |
| 3,842,819 A | | 10/1974 | Atkins et al. | |
| 3,934,566 A | * | 1/1976 | Ward | 123/148 E |
| 4,041,922 A | | 8/1977 | Abe et al. | |
| 4,122,816 A | | 10/1978 | Fitzgerald et al. | |
| 4,366,801 A | | 1/1983 | Endo et al. | |
| 4,369,756 A | | 1/1983 | Ezoe | |
| 4,369,758 A | | 1/1983 | Endo | |
| 4,398,526 A | | 8/1983 | Hamai et al. | |
| 4,418,660 A | | 12/1983 | Endo et al. | |
| 4,433,669 A | | 2/1984 | Ishikawa et al. | |
| 4,448,181 A | | 5/1984 | Ishikawa et al. | |
| 4,455,989 A | | 6/1984 | Endo et al. | |
| 4,471,732 A | | 9/1984 | Tozzi | |
| 4,487,177 A | | 12/1984 | Ishikawa | |
| 4,487,192 A | | 12/1984 | Anderson et al. | |
| 4,493,297 A | | 1/1985 | McIlwain et al. | |
| 4,677,960 A | | 7/1987 | Ward | |

(List continued on next page.)

FOREIGN PATENT DOCUMENTS

| | | |
|---|---|---|
| WO | WO 88/04729 A1 | 8/1988 |
| WO | WO 91/15677 A1 | 10/1991 |
| WO | WO 93/10348 A1 | 5/1993 |

OTHER PUBLICATIONS

Matthews, R.D., et al., "Further Analysis of Railplugs as a New Type of Ignitor," SAE, Oct. 1992, pp. 1–15, vol. 922167.

Clements, R.M. et al., "An Experimental Study of the Ejection Mechanism for Typical Plasma Jet Ignitors," Combustion and Flame, 1981, pp. 287–295, vol. 42.

(List continued on next page.)

*Primary Examiner*—Gene Mancene
*Assistant Examiner*—Arnold Castro
(74) *Attorney, Agent, or Firm*—Wolf, Greenfield & Sacks, P.C.

(57) ABSTRACT

An ignitor and associated electronics for igniting a combustible mixture in a cylinder of an internal combustion engine are described. The ignitor includes at least two spaced-apart electrodes that define a discharge gap. The space between the electrodes is substantially filled with a dielectric material. The dielectric material is spaced-apart from at least one of the electrodes to provide an air gap over which an initial voltage breakdown between the electrodes will occur. The air gap serves to vary the location of the initial breakdown and as a barrier to a short circuit between the electrodes due to carbon and/or metal deposit buildup on the dielectric material. The associated electronics provide a first potential between the electrodes that generates a plasma between the electrodes. Then the volume of the plasma is increased by the application of a second potential that creates a current through the plasma. The plasma, as well as the current passing through, is swept outward due to the interaction of Lorentz and thermal expansion forces with the plasma. Also described are relative orientations of the electrodes that lead to greater plasma formation.

58 Claims, 25 Drawing Sheets

U.S. PATENT DOCUMENTS

| | | | | | |
|---|---|---|---|---|---|
| 4,760,820 | A | | 8/1988 | Tozzi | |
| 4,766,855 | A | | 8/1988 | Tozzi | |
| 4,774,914 | A | | 10/1988 | Ward | |
| 4,805,570 | A | | 2/1989 | Davis | |
| 4,841,925 | A | | 6/1989 | Ward | |
| 4,930,473 | A | | 6/1990 | Dietrich | |
| 4,996,967 | A | | 3/1991 | Rosswurm et al. | |
| 5,007,389 | A | | 4/1991 | Kashiwara et al. | |
| 5,076,223 | A | | 12/1991 | Harden et al. | |
| 5,131,376 | A | | 7/1992 | Ward et al. | |
| 5,197,448 | A | | 3/1993 | Porreca et al. | |
| 5,207,208 | A | | 5/1993 | Ward | |
| 5,211,142 | A | | 5/1993 | Matthews et al. | |
| 5,215,066 | A | | 6/1993 | Narishige et al. | |
| 5,228,425 | A | | 7/1993 | Simons | |
| 5,377,633 | A | | 1/1995 | Wakeman | |
| 5,423,306 | A | | 6/1995 | Trigger et al. | |
| 5,456,241 | A | * | 10/1995 | Ward | 123/169 EL |
| 5,513,605 | A | | 5/1996 | Weldon | |
| 5,517,961 | A | | 5/1996 | Ward | |
| 5,555,862 | A | * | 9/1996 | Tozzi | 123/143 B |
| 5,603,306 | A | * | 2/1997 | Tai | 123/633 |
| 5,619,959 | A | | 4/1997 | Tozzi | |
| 5,704,321 | A | * | 1/1998 | Suckewer et al. | 123/143 B |
| 6,131,542 | A | * | 10/2000 | Suckewer et al. | 123/143 B |

OTHER PUBLICATIONS

Maly, R., "Ignition Model For Spark Disckarges and the Early Phase of Flame Front Growth," Eighteenth Symposium (International) on Combustion, 1981, pp. 1747–1754, The Combustion Institute.

Quader, A.A., "How Injector, Engine and Fuel Variables Impact Smoke and Hydrocarbon Emissions with Port Fuel Injection," SAE, 1989, pp. 1–23, vol. 89062.

Bradley and Critchley, "Electromagnetically Induced Motion of Spark Ignition Kernels," Combustion and Flame, 1974, pp. 143–152, vol. 22.

Hall, M.J., et al, "Initial Studies of a New Type of Ignitor: The Railplug," SAE, 1991, pp. 1730–1740, vol. 912319.

Vanduyne, E. and Porreca, P., "Performance Improvement From Dual Energy Ignition On A Methanol Injected Cosworth Engine," SAE, 1994, pp. 73–80, vol. 940150.

* cited by examiner

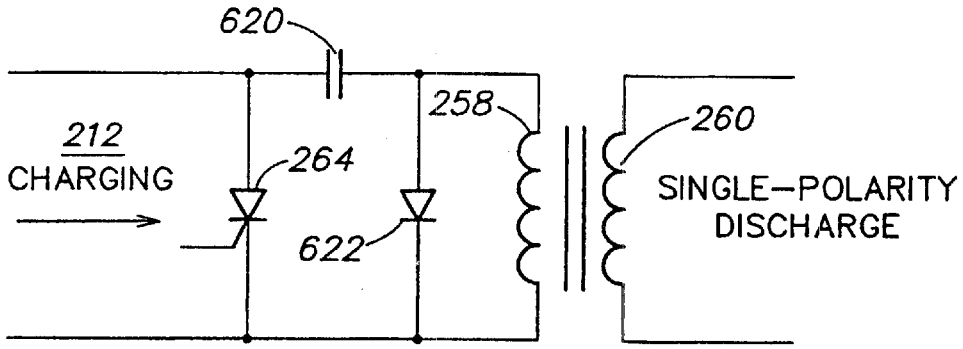
FIG. 14A
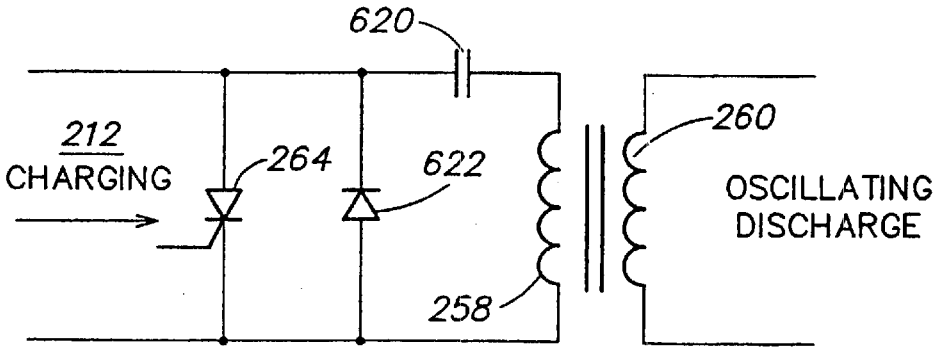
FIG. 14B
FIG. 14C
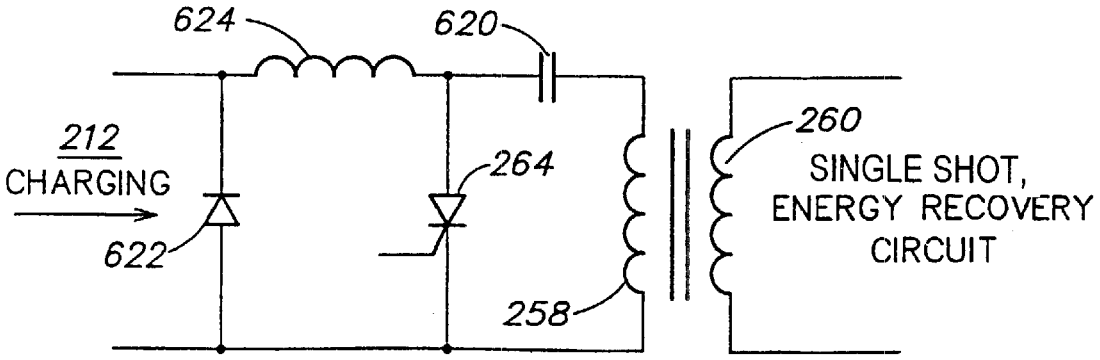

LONG-LIFE TRAVELING SPARK IGNITOR AND ASSOCIATED FIRING CIRCUITRY

This application claims the benefit of provisional application 60/155,691 filed Sep. 15, 1999.

FIELD OF THE INVENTION

This invention relates generally to internal combustion engine ignition systems and, more particularly to a traveling spark ignitor having a long-life and associated firing circuity therefore.

BACKGROUND OF THE INVENTION

Internal combustion engines have undergone many changes since their initial development at the end of the last century. Many of these evolutionary changes can be seen as a maturing of technology, with the fundamental principles remaining the same. Such is the case with the ignition system. Some of its developments include the replacement of mechanical distributors by electronic ones, increasing reliability and allowing for easy adjustment of the spark timing under different engine operating conditions. The electronics responsible for creating the high voltage required for the discharge have changed, with transistorized coil ignition (TCI) and capacitive discharge ignition (CDI) systems common today.

The need for an enhanced ignition source has long been recognized. Many inventions have been made which provide enlarged ignition kernels. The use of plasma jets and Lorentz force plasma accelerators have been the subject of much study and many patents. The primary weakness of some of the prior inventions has been the requirement for excessive ignition energy, which eliminates any possible efficiency enhancement in the engine in which they are employed. These higher ignition energy requirements have resulted in high rates of ignitor electrode erosion, which reduces the operating life of such ignitors to unacceptable levels.

The electrical energy required in these earlier systems, e.g., Fitzgerald et al., U.S. Pat. No. 4,122,816, is claimed to be more than 2 Joules per firing (col. 2, lines 55–63). This energy is about 40 times higher than that used in conventional spark plugs.

Matthews et al., infra, reports the use of 5.5 Joules of electrical energy per ignition, or more than 100 times the energy used in conventional ignition systems.

Consider a six cylinder 4-stroke engine operating at 3600 RPM, which requires firing three cylinders every engine revolution, or 180 firings per second. At 2 Joules per firing this is 360 Joules/second. This energy must be provided by the combustion engine at a typical efficiency of about 18% and converted to a suitable high voltage by power conversion devices with a typical efficiency of about 40%, for a net use of the engine fuel at an efficiency of about 7.2%. Fitzgerald requires a fuel energy consumption of 360/0.072 Joules/second, or about 5000 Joules/second just to run the ignition system.

To move a 1250 kg vehicle on a level road at about 80 km/hr (about 50 mph) requires an energy consumption rate of about 9000 Joules/second. At an engine fuel to motive force conversion efficiency of 18%, about 50,000 Joules/second of fuel will be consumed. Thus, the system employed by Fitzgerald et al, infra, will use about 10% of the fuel energy consumed to run the vehicle to operate the ignition system. This is greater than the efficiency gain to be expected by use of the Fitzgerald et al. ignition systems.

By comparison, conventional ignition systems use about 0.25 percent of the fuel energy to run the ignition system. However, the high energy employed in these systems causes high levels of erosion to occur in the electrodes of the spark plugs, thus reducing the useful operating life considerably. This shortened life is demonstrated in the work by Matthews et al., infra, where the need to reduce ignition energy is acknowledged although no solution is provided.

Additional attempts at solving this problem are shown in the work by Tsao and Durbin (Tsao, L. and Durbin, E. J., "Evaluation of Cyclic Variation and Lean Operation in a Combustion Engine with a Multi-Electrode Spark Ignition System", *Princeton Univ., MAE Report*, (January, 1984)), where a larger than regular ignition kernel was generated by a multiple electrode spark plug, demonstrating a reduction in cyclic variability of combustion, a reduction in spark advance, and an increase in output power. The increase in kernel size was only six times that of an ordinary spark plug.

Bradley and Critchley (Bradley, D., Critchley, I. L., "Electromagnetically Induced Motion of Spark Ignition Kernels", *Combust. Flame* 22, pgs. 143–152 (1974)) were the first to consider the use of electromagnetic forces to induce a motion of the spark, with an ignition energy of 12 Joules. Fitzgerald (Fitzgerald, D. J., "Pulsed Plasma Ignitor for Internal Combustion Engines", *SAE paper* 760764 (1976); and Fitzgerald, D. J., Breshears, R. R., "Plasma Ignitor for Internal Combustion Engine", U.S. Pat. No. 4,122,816 (1978)) proposed to use pulsed plasma thrusters for the ignition of automotive engines with much less but still substantial ignition energy (approximately 1.6J). Although he was able to extend the lean limit, the overall performance of such plasma thrusters used for ignition systems was not significantly better than that of regular spark plugs and the sparks they produce. In this system, much more ignition energy was used without a significant increase in plasma kernel size. (Clements, R. M., Smy, P. R., Dale, J. D., "An Experimental Study of the Ejection Mechanism for Typical Plasma Jet Ignitors", *Combust. Flame* 42, pages 287–295 (1981)). More recently Hall et al. (Hall, M. J., Tajima, H., Matthews, R. D., Koeroghlian, M. M., Weldon, W. F., Nichols, S. P., "Initial Studies of a New Type of Ignitor: The Railplug", *SAE paper* 912319 (1991)), and Matthews et al. (Matthews, R. D., Hall, M. J., Faidley, R. W., Chiu, J. P., Zhao, X. W., Annezer, I., Koening, M. H., Harber, J. F., Darden, M. H., Weldon,2

W. F., Nichols, S. P., "Further Analysis of Railplugs as a New Type of Ignitor", *SAE paper* 922167 (1992)), have shown that a "rail plug" operated at an energy of over 6J (2.4cm long) showed a very substantial improvement in combustion bomb experiments. They also observed improvements in the lean operation of an engine when they ran it with their spark plug at an ignition energy of 5.5J. They attributed the need of this excessive amount of energy to poor matching between the electrical circuit and the spark plug. This level of energy expended in the spark plug is about 25% of the energy consumed in propelling a 1250 kg vehicle at 80 km/hr on a level road. Any efficiency benefits in engine performance would be more than consumed by the increased energy in the ignition system. All of the above references are herein incorporated by reference.

SUMMARY OF THE INVENTION

Various aspects of the present invention overcome the above and other drawbacks in the art of ignitors and ignition systems for internal combustion engines. In one embodiment of the present invention, a plasma-generating device having a long-life is disclosed. As used herein, the term "plasma-generating device" refers to an ignitor (spark plug) that generates a large volume of plasma. One specific type of plasma generating-device is a traveling spark ignitor (TSI). A TSI generates an initial spark between two electrodes due to a first high voltage between the electrodes. This initial spark creates a plasma that is then swept outwards due to both Lorentz and thermal expansion forces. As the spark is swept outwards, at least some of the gas present in the space between the electrodes is converted to plasma. Examples of TSI's are disclosed in U.S. Pat. No. 5,704,321, filed Oct. 11, 1996, and U.S. patent applications Ser. No. 09/204,440, entitled High Efficiency Traveling Spark Ignition System and Ignitor Therefore, filed Dec. 2, 1998, both of which are incorporated herein by reference.

According to one illustrative embodiment, a plasma-generating device is disclosed. The plasma-generating device of this embodiment includes at least two spaced-apart electrodes including a first electrode and a second electrode having a discharge gap between them, and dielectric material filling a substantial portion of the space between the first electrode and the second electrode. The dielectric material has an upper surface and a lower surface and is spaced apart from at least a portion of the second electrode by a width of the lower surface, to define an air gap between the upper surface and the second electrode. The electrodes are dimensioned and configured and their spacing is being arranged such that when a sufficiently high first voltage is applied across the electrodes when the device is disposed in a combustion chamber of an engine, a discharge occurs and a plasma is formed between the electrodes at an initiation region. The plasma moves outwardly along the electrodes and away from the surface of the initiation region under both a thermal expansion force and a Lorentz force. The discharge is associated with, or results in part in, electrode ablation. The air gap may serve to help reduce this ablation by In another illustrative embodiment, a traveling spark ignitor is disclosed. The traveling spark ignitor of this embodiment includes at least two spaced-apart electrodes including a first electrode and a second electrode having a discharge gap between them and dielectric material filling a substantial portion of the space between the first electrode and the second electrode. The dielectric material has an upper surface and a lower surface and is spaced apart from at least a portion of the second electrode by a width of the lower surface to define an air gap between the upper surface and the second electrode. The traveling spark ignitor may also include a co-axial connector to connect a co-axial cable to the ignitor. The electrodes are dimensioned and configured and their spacing is arranged such that when a sufficiently high first voltage is applied across the electrodes in a combustion chamber of an engine, a plasma is formed between the electrodes at an initiation region. The plasma moves outwardly along the electrodes and away from the initiation region due to a Lorentz force.

In another embodiment, a system of igniting a gaseous mixture of air and fuel in a combustion chamber of an internal combustion engine is disclosed. The system of this embodiment includes a traveling spark ignitor that includes at least two spaced-apart electrodes including a first electrode and a second electrode having a discharge gap between them and dielectric material filling a substantial portion of the space between the electrodes. The dielectric material is spaced apart from at least a portion of the second electrode to define an air gap. The system also includes means for alternatively producing a first and second potential difference between the electrodes, the first potential creating a plasma in an unfilled portion of the discharge gap at a plasma initiation region, the second potential sustaining a current through the plasma, whereby a magnetic field from the current interacts with an electric field from the potential difference between the electrodes to cause the plasma to move outwardly from the initiation region under a Lorentz force.

BRIEF DESCRIPTION OF THE DRAWINGS

Various embodiments of the invention are illustrated and described below with reference to the accompanying drawings, in which like items are identified by the same reference designation, wherein:

FIGS. 14A–14C show alternative embodiments of a primary electronics of FIG. 11.

DETAILED DESCRIPTION

The following detailed description will describe several embodiments and components of aspects of the present invention. It should be understood that various aspects of the invention may be combined or omitted depending upon the context and that the required elements for each embodiment are included only in the appended claims.

I. General Theory of Operation

The following discussion will relate to the general operation of a plasma-generating device in order to more clearly explain aspects of the present invention.

Figure 1:
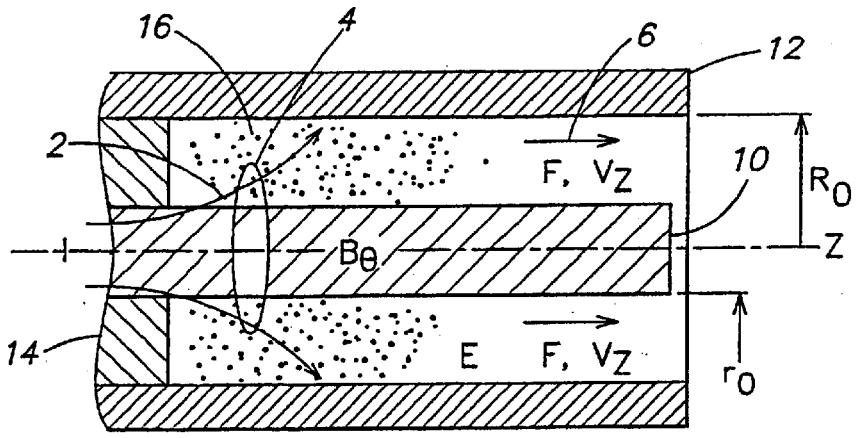
FIG. 1 is a cross-sectional view of a cylindrical Marshall gun with a pictorial illustration of its operation, which is useful in understanding the invention.

FIG. 1 shows a simplified embodiment of a prior art Marshall gun (plasma gun) that, with limitation, presents an effective way of creating a large volume of plasma. The schematic presentation in FIG. 1 shows the electric field 2 and magnetic field 4 in an illustrative Marshall gun, where Bθis the poloidal magnetic field directed along field line 4. The plasma 16 is moved in an outward direction 6 by the action of the Lorentz force vector F and thermal expansion, with new plasma being continually created by the breakdown of fresh gas as the discharge continues. $V_z$ is the plasma kernel speed vector, also directed in the z-direction represented by arrow 6. Thus, the plasma 16 grows as it moves along and through the spaces between electrodes 10, 12 (which are maintained in a spaced relationship by isolator or dielectric 14). Once the plasma 16 leaves the electrodes 10, 12, it expands in volume, cooling in the process. It ignites the combustibles mixture after it has cooled to the ignition temperature. Fortunately, increasing plasma volume is consistent with acknowledged strategies for reducing emissions and improving fuel economy. Two such strategies are to increase the dilution of the gas mixture inside the cylinder and to reduce the cycle-to-cycle variations.

Dilution of the gas mixture, which is most commonly achieved by the use of either excess air (running the engine lean) or exhaust gas recirculation (EGR), reduces the formation of oxides of nitrogen by lowering the combustion temperature. Oxides of nitrogen play a critical role in the formation of smog, and their reduction is one of the continuing challenges for the automotive industry. Dilution of the gas mixture also increases the fuel efficiency by lowering temperature and thus reducing the heat loss through the combustion chamber walls, improving the ratio of specific heats, and by lowering the pumping losses at a partial load.

Zeilinger determined the nitrogen oxide formation per horsepower-hour of work done, as a function of the air to fuel ratio, for three different spark timings (Zeilinger, K., Ph.D. thesis, Technical University of Munich (1974)). He found that both the air-to-fuel ratio and the spark timing affect the combustion temperature, and thus the nitrogen oxide formation. As the combustible mixture or air/fuel ratio (A/F) is diluted with excess air (i.e., A/F larger than stoichiometric), the temperature drops. At first, this effect is diminished by the increase in the amount of oxygen. The $NO_x$ formation increases. When the mixture is further diluted, the $NO_x$ formation decreases to values much below those at a stoichiometric mixture because the combustion temperature decline overwhelms the increase in $O_2$.

A more advanced spark timing (i.e., initiating ignition more degrees before top dead center) raises the peak temperature and decreases engine efficiency because a larger fraction of the combustible mixture burns before the piston reaches top dead center (TDC) and the mixture is compressed to a higher temperature, hence leading to much higher $NO_x$ levels and heat losses. As the mixture is made lean, the spark timing which gives the maximum brake torque (MBT timing) increases.

Dilution of the mixture results in a reduction of the energy density and the flame propagation speed, which affect ignition and combustion. The lower energy density reduces the heat released from the chemical reaction within a given volume, and thus shifts the balance between the chemical heat release and the heat lost to the surrounding gas. If the heat released is less than that lost, the flame will not propagate. Thus, a larger initial flame is needed.

Reducing the flame propagation speed increases the combustion duration. Ignition delay results from the fact that the flame front is very small in the beginning, which causes it to grow very slowly, as the quantity of fuel-air mixture ignited is proportional to the surface area. The increase in the ignition delay and the combustion duration leads to an increase of the spark advance and larger cycle-to-cycle variations which reduces the work output and increases engine roughness. A larger ignition kernel will reduce the advance in spark timing required, and thus lessen the adverse effects associated with such an advance. (These adverse effects are an increased difficulty to ignite the combustible mixture, due to the lower density and temperature at the time of the spark, and an increase in the variation of the ignition delay, which causes driveability to deteriorate).

Cyclic variations are caused by unavoidable variations in the local air-to-fuel ratio, temperature, amount of residual gas, and turbulence. The effect of these variations on the cylinder pressure is due largely to their impact on the initial expansion velocity of the flame. This impact can be significantly reduced by providing a spark volume which is appreciably larger than the mean sizes of the inhomogeneities.

A decrease in the cyclic variations of the engine combustion process will reduce emissions and increase efficiency, by reducing the number of poor burn cycles, and by extending the operating air fuel ratio range of the engine.

While increasing spark volume, some embodiments of the present invention may also provide for expelling the spark deeper into the combustible mixture, with the effect of reducing the combustion duration.

To achieve these goals, some embodiments of the present invention utilize ignitors having electrodes of relatively short length with a relatively large distance between them; that is, the distance between the electrodes is large relative to electrode length.

II. Configuration of the Plasma-Generating Devices (Ignitors)

The following description will explain various aspects of embodiments of plasma-generating devices according to the present invention.

Figure 2:
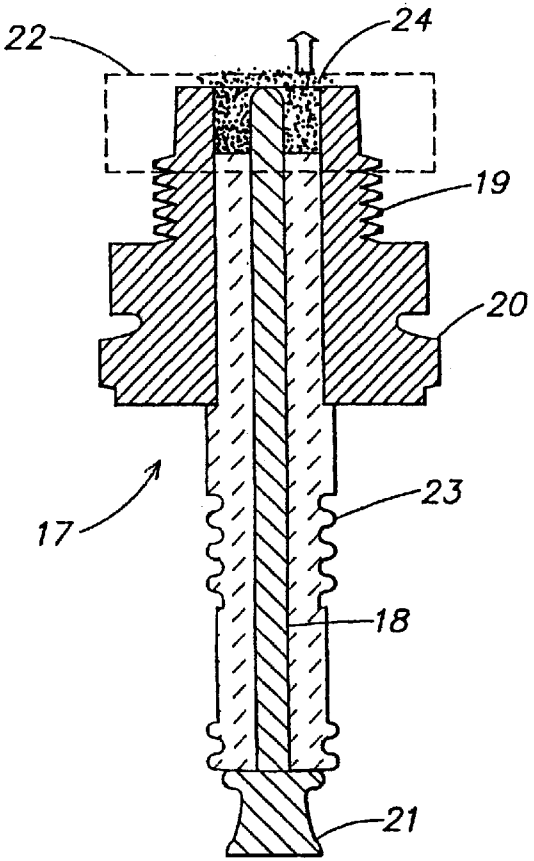
FIG. 2 is a cross-sectional view of a cylindrical traveling spark ignitor for one embodiment of this invention, taken through the axes of the cylinder, including two electrodes and wherein the plasma produced travels by expanding in the axial direction.

FIG. 2 shows one illustrative embodiment of a TSI 17 according to the present invention. This embodiment has standard mounting means 19 such as threads for mounting the TSI 17 in a combustion chamber such as a piston chamber of an internal combustion engine. These threads may mount the TSI in the combustion chamber such that the electrodes extend specific distances into the combustion chamber. The mounting of the TSI 17 may affect the operation of an internal combustion engine and is discussed in greater detail below.

The TSI 17 also contains a standard male spark plug connector 21, and insulating material 23. The tip 22 of the TSI 17 varies greatly from a standard spark plug. In one embodiment, the tip 22 includes two electrodes, a first electrode 18 and a second electrode 20. The particular embodiment shown in FIG. 2 has the first electrode 18 coaxially disposed within the second electrode 20; that is, the second electrode 20 surrounds the first electrode 18. The first electrode 18 is attached to a distal boot connector 21. The space between the electrodes is substantially filled with insulating material (or dielectric) 23.

Application of a voltage to the TSI 17 between the first and second electrodes, 18 and 20, causes a discharge originating on the surface of the insulating material 23. The voltage required for a discharge across the insulating material 23 is lower than for a discharge between the electrodes 18 and 20 some distance away from the insulating material 23. Therefore, the initial discharge occurs across the insulating material 23. The location of the initial discharge shall be referred to herein as the "initiation region." This initial discharge constitutes an ionization of the gas (an air/fuel mixture), thereby creating a plasma 24. This plasma 24 is a good conductor and supports a current between the first electrode 18 and the second electrode 20 at a lower voltage than was required to form the plasma. The current through the plasma serves to ionize even more gas into a plasma. The current-induced magnetic fields surrounding the electrode and the current passing through plasma the interact to produce a Lorentz force on the plasma. This force causes the point of origin of current though the plasma to move and, thus, creates a larger volume of plasma. This is in contrast to traditional ignition systems wherein the spark initiation region remains fixed. The Lorentz force created also serves to expel the plasma from the TSI 17. Inherent thermal expansion of the plasma aids in this expulsion. That is, as the plasma heats and expands it is forced to travel outwardly, away from the surface of the dielectric material 23.

The first and seconds electrodes, 18 and 20, respectively, may be made from materials which may include any suitable conductor such as steel, clad metals, platinum-plated steel (for erosion resistance or "performance engines"), copper, and high-temperature electrode metals such as molybdenum or tungsten, for example. The electrodes (one or both) may be of a metal having a controlled thermal expansion like Kovar (a trademark and product of Carpenter Technology Corp.) and coated with a material such as cuprous oxide so as to give good subsequent seals to glass or ceramics. Electrode materials may also be selected to reduce power consumption. For instance, thoriated tungsten could be used, as its slight radioactivity may help to pre-ionize the air or air-fuel mixture between the electrodes, possibly reducing the required ignition voltage. Also, the electrodes may be made of high-Curie temperature permanent magnet materials, polarized to assist the Lorentz force in expelling the plasma.

The electrodes, except for a few millimeters at their ends, are separated by insulating material 23 which may be an isolator or insulating material which is a high temperature dielectric. This material can be porcelain, or a fired ceramic with a glaze, as is used in conventional spark plugs, for example. Alternatively, it can be formed of refractory cement, a machinable glass-ceramic such as Macor (a trademark and product of Corning Glass Company), or molded alumina, stabilized zirconia or the like fired and sealed to the metal electrodes such as with a solder glass frit, for example. As above, the ceramic could also comprise a permanent magnet material such as barium ferrite.

It should be appreciated that the second electrode 20 need not necessarily be a complete cylinder that completely surrounds the first electrode 18. That is, the second electrode 20 may have portions removed from it so that there are spaces separating pieces of the second electrode 20 from other pieces. These pieces, if connected, would create a complete circle that surrounds the first electrode 18.

Figure 3A:
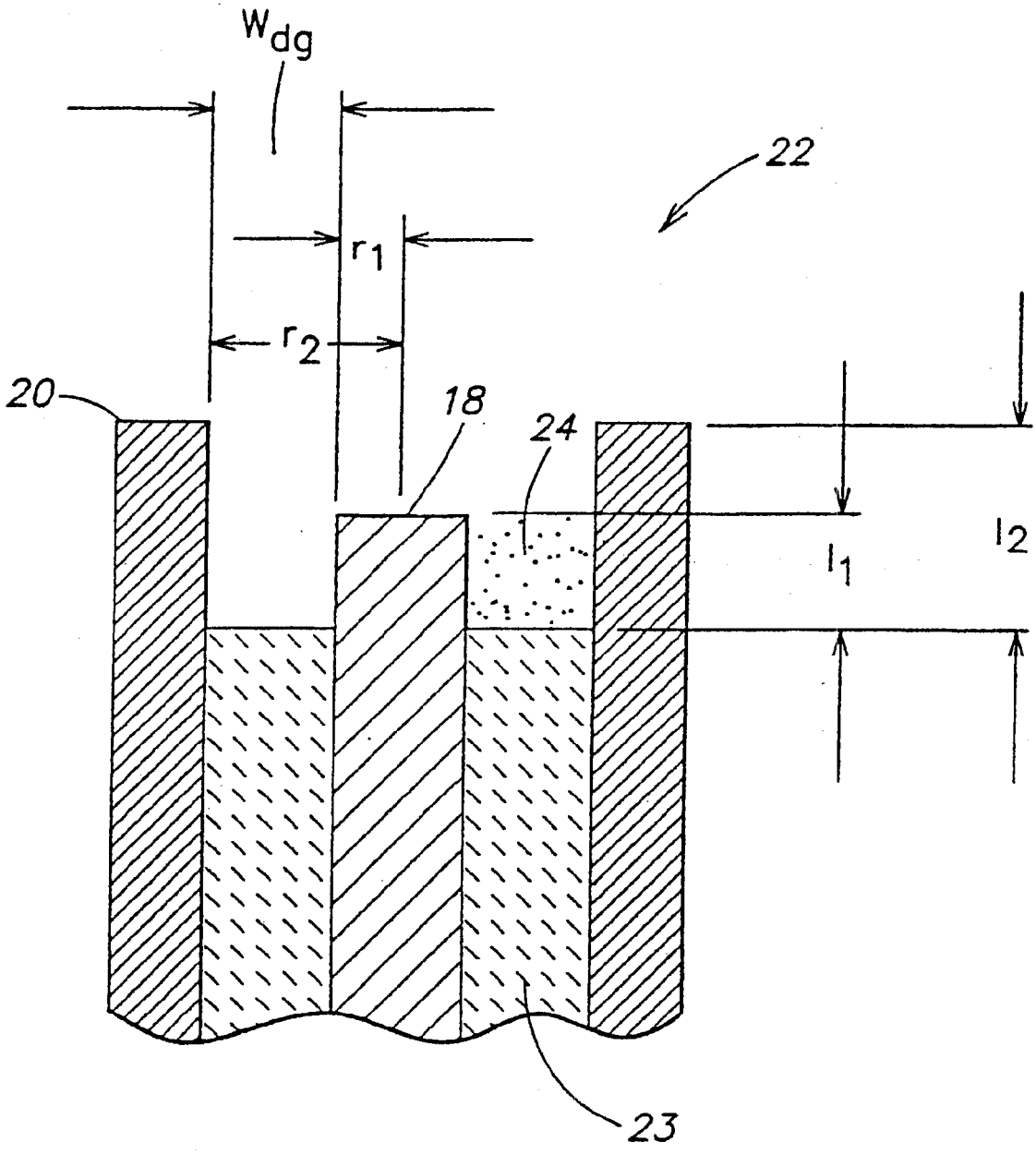
FIG. 3A is a detailed view of the tip of a cylindrical traveling spark ignitor for the embodiment shown in FIG. 2.

FIG. 3A is a more detailed cross-sectional view of one possible embodiment for the tip 22 shown in FIG. 2. The particular embodiment shown here relates to TSI 17. However, it should be noted that the specific properties of this configuration could be applied to any of the below-discussed embodiments, for example TSI's 27, 101 and 120, or to any embodiment later discovered.

The tip 22, as shown, includes a first electrode 18 and a second electrode 20. Between the first and second electrodes is an insulating material 23. The insulating material 23 fills a substantial portion of the space between the electrodes 18 and 20. The portion of the space between the electrodes 18 and 20 not filled by the insulating material 23 is referred to herein as the discharge gap. This discharge gap has a width $W_{dg}$ which is the distance between the electrodes 18 and 20 and is measured at their nearest point. The length by which the first electrode 18 extends beyond the insulating material 23 is denoted herein as $\mathbf{1}_1$ and the length by which the second electrode 20 extends beyond the insulating material is denoted as $\mathbf{1}_2$. The shorter of $\mathbf{1}_1$ or $\mathbf{1}_2$ shall be referred to herein as the length of the discharge gap. The first electrode 18 has a radius $r_1$ and the second electrode 20 has a radius $r_2$. The difference between the radii of the second and first electrodes, $r_2-r_1$, represents the width of the discharge gap $W_g$. It should be noted however that $W_g$ may also be represented by the distance between two spaced apart non-concentric electrodes.

The current through the first electrode 18 and the plasma 24 to the second electrode 20 creates around the first electrode 18 a poloidal (angular) magnetic field $B_\theta(I, r)$, which depends on the current and distance (radius r°, see FIG. 1) from the axis of the first electrode 18. Hence, a current I flowing through the plasma 24 perpendicular to the poloidal magnetic field $B_\theta$generates a Lorentz force F on the charged particles in the plasma 24 along the axial direction z of the electrodes 18, 20. The force is approximately computed as follows in equation (1):

$$F \sim I \times B \rightarrow F_z \sim I_r \cdot B_\theta \quad (1)$$

This force accelerates the charged particles which, due to collisions with non-charged particles, accelerates all the plasma. Note that the plasma consists of charged particles (electrons and ions), and neutral atoms. The temperature is not sufficiently high in the discharge gap to fully ionize all atoms.

The original Marshall guns as a source of plasma for fusion devices were operated in a vacuum with a short pulse of gas injection between the electrodes. The plasma created between the electrodes by the discharge of a capacitor was accelerated a distance of a dozen centimeters to a final velocity of about $10^7$ cm/sec. The drag force $F_v$ on the plasma is approximately proportional to the square of the plasma velocity, as shown below in equation (2):

$$F_v \sim V_p^2 \quad (2)$$

The distance over which the plasma accelerates is short (1–3 mm). Indeed, experimentation has shown that increasing the length of the plasma acceleration distance beyond 1 to 3 mm does not significantly increase the plasma exit velocity, although electrical energy used to drive such a TSI is increased significantly. At atmospheric pressures and for electrical input energy of about 300 mJ, the average velocity is close to $5\times10^4$ cm/sec and will be lower at high pressure in the engine. At a compression ratio of 8:1, this average velocity will be approximately $3\times10^4$ cm/sec.

By contrast, if more energy is put into a single discharge of a conventional spark, its intensity is increased somewhat, but the volume of the plasma created does not increase significantly. In a conventional spark, a much larger fraction of the energy input goes into heating the electrodes when the conductivity of the discharge path is increased.

Given the above dimensioning constraints, the present invention optimizes the combination of the electromagnetic (Lorentz) and thermal expansion forces when the TSI is configured according to the following approximate condition:

$$(r_2-r_1)/\mathbf{1}_x \geqq 1/3 \quad (3)$$

where $\mathbf{1}_x$ is the length of the shorter one of $\mathbf{1}_1$ or $\mathbf{1}_2$. It should be noted that the dimensional boundaries just expressed are approximate; small deviations above or below them still yield a functional TSI according to the present invention though probably with less than optimal performance. Also, as these dimensions define only the outer bounds, one skilled in the art would realize that there are many configurations which will satisfy these dimensional characteristics.

The quantity $(r_2-r_1)/\mathbf{1}_x$ represents the gap-to-length ratio in this representation. A smaller gap-to-length ratio may increase the Lorentz force that drives the plasma out of the TSI for the same input energy (when there is a larger current due to lower plasma resistance). If this gap-to-length ratio is too small, the additional energy provided by the Lorentz force goes primarily into erosion of the electrodes due to an increase of the sputtering process on the electrodes. Further, as described above, an optimally performing TSI should form a large volume plasma. Increasing the gap-to-length ratio for the same electrode length increases the volume in which the plasma may be formed and thereby contributes to the increase of the plasma volume produced. Thus, the TSI of the present invention preferably has a sufficiently large gap-to-length ratio such that there is enough volume within which to form a plasma. This volume constraint also serves to set a lower limit for the gap-to-length ratio. A gap-to-length ratio of approximately ⅓ or higher has been found to create an optimal balance between these two constraints.

Contrary to early attempts where acceleration of plasma led to the input energy loss due to drag forces which grow with the square of velocity, the large gap-to-length ratio provides for the generation of a large volume of plasma which expelled at a lower velocity. The lower velocity reduces the drag force, thereby reducing the required input energy. Reduced input energy results in a lesser degree of electrode erosion, leading, in turn, to a TSI having a previously unattainable lifetime.

Preferably, the TSI ignition system of the present invention uses no more than about 400 mJ per firing. By contrast, early plasma and Marshall gun ignitors have not achieved practical utility because they employed much larger ignition energies (e.g., 2–10 Joules per firing), which caused rapid erosion of the ignitor and short life. Further efficiency gains in engine performance were surrendered by increased ignition system energy consumption.

Figure 3B:
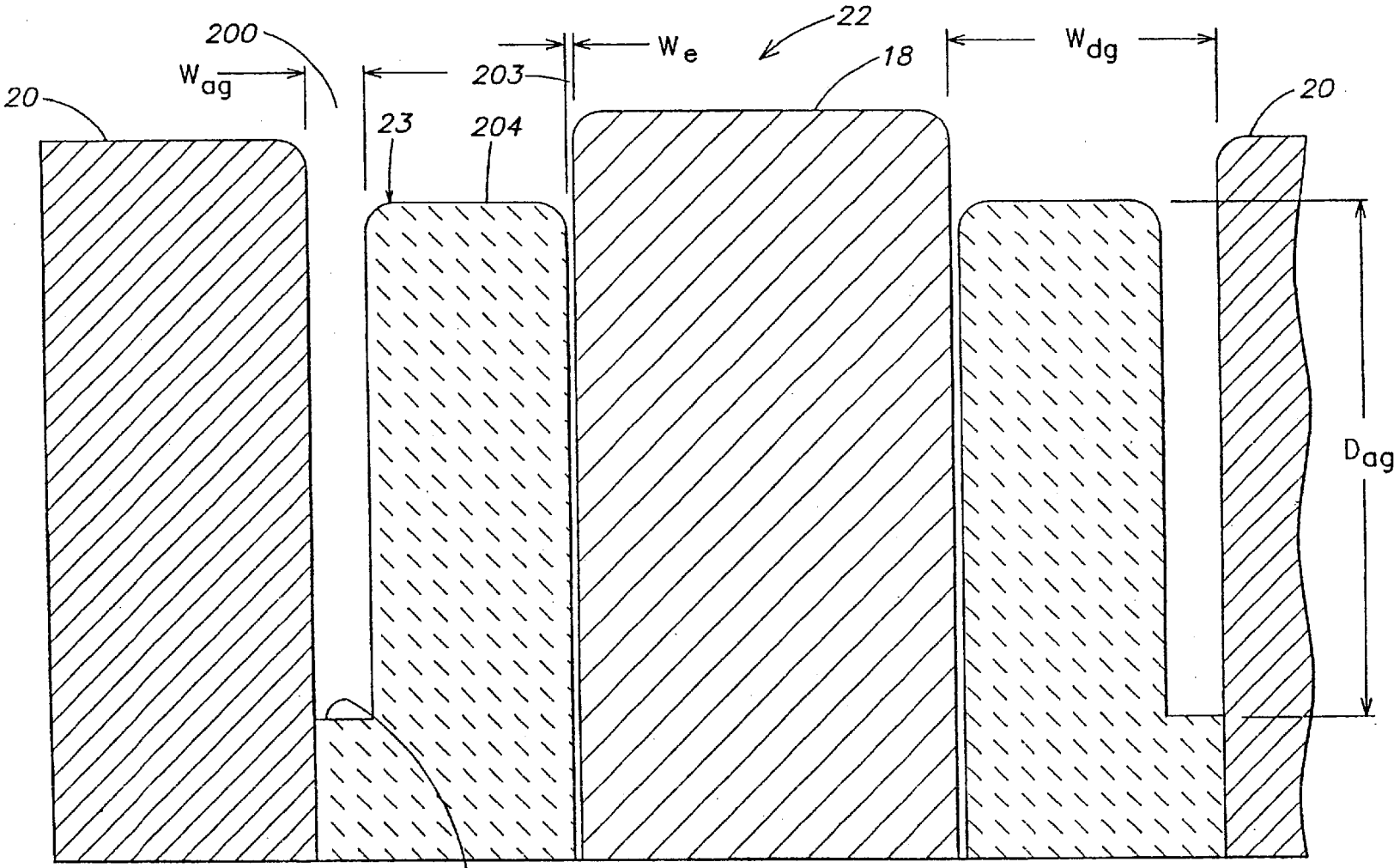
FIG. 3B is a detailed view of one embodiment if a tip of a cylindrical traveling spark ignitor.

FIG. 3B shows an alternative embodiment of a tip 22 portion of a TSI. In this embodiment there exists an air gap 200 in the direct path over the surface of insulating material 23 between the first electrode 18 and the second electrode 20. This air gap 200 has a width $W_{ag}$ and a depth $D_{ag}$. The width $W_{ag}$ and the depth $D_{ag}$ may vary between individual TSI's but are fixed for each individual TSI. The insulating material in this configuration includes a upper surface 204 and a lower surface 205 located at the base bottom of the air gap 200. An ignitor having an upper surface 204 and lower surface 205 such as that shown in FIG. 3B shall be referred to herein as a "semi-surface discharge" ignitor. It should be appreciated that a semi-surface discharge ignitor need not have the dimensional ratios shown in FIG. 3B.

The air gap 200 serves several distinct purposes but its dominant effect is to increase the lifetime of the TSI. First, the air gap 200 helps to prevent the electrodes 18 and 20 from being short circuited due to a build up of a complete conduction path over the insulating material 23. Such a conduction path may be created by a number of mechanisms. For example, every time a TSI is fired, a portion of the metal of the electrodes is blasted away. This removal of electrode metal is known as ablation. Ablation of the electrodes produces a film of metal deposits over the surface of the insulating material 23. This film, over time, may become solid and thick enough to carry a current and thereby become a conduction path. Another way in which a conduction path between the electrodes could be created is from an excessive build up of carbon deposits or the like on the conduction material 204. If the build up of carbon deposits becomes large enough to carry a current, a short circuit of the electrodes may result. This direct interconnection leads to a greater amount of energy being imparted to and consumed by the TSI 17 without an appreciable increase in plasma volume. The air gap 200 provides a physical barrier which the conduction path must bridge before such a short circuit condition may occur. That is, in order for a short circuit to occur, the air gap would have to be completely bridged with metal or carbon or a combination thereof.

The air gap 200 also serves to help reduce electrode wear. In the absence of the air gap 200, the initial discharge has been found to occur between the same points on the electrodes every time the TSI 17 is used to ignite a plasma kernel. Namely, the initial discharge would occur at the point where the insulating material contacted the second electrode 20 (assuming a discharge from the first electrode 18 to the second electrode 20). Because the discharge occurs at the same point, the second electrode 20 wears out quicker at the point of discharge and eventually is destroyed. Introduction of the air gap 200 causes the initial discharge points to vary. By spreading the discharge points across electrode 20, the wear is spread over a greater surface; this significantly increases electrode life. The second electrode 20 is preferably a substantially smooth surface. This allows for the spark to jump to more places on the second electrode 20 and thereby increases the area over which wear occurs. This is shown schematically and discussed in more detail in relation to FIG. 4.

Figure 4:
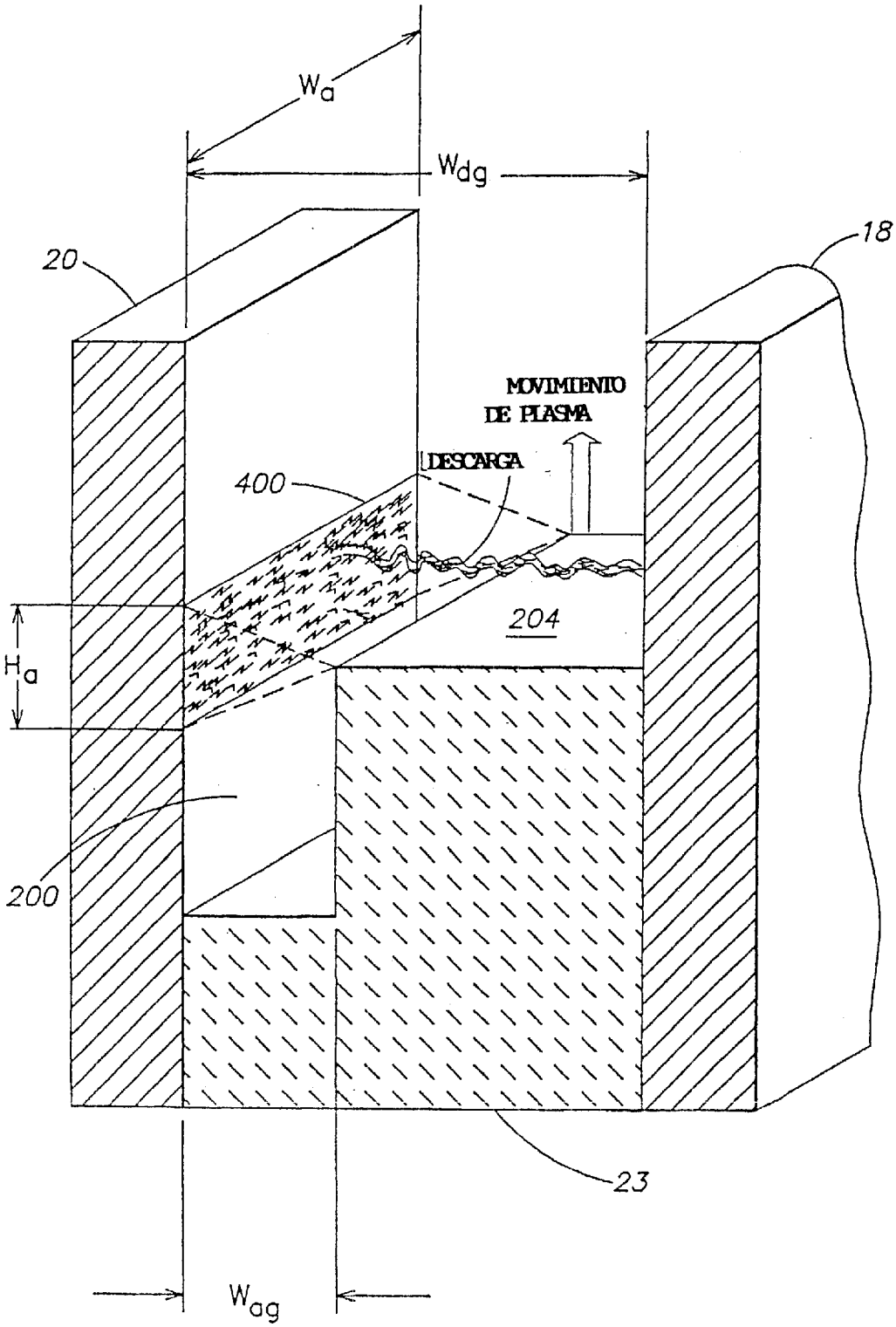
FIG. 4 is a three dimensional cross-sectional view further defining one embodiment of the present invention.

FIG. 4 is an example of a cut-away side view of one side of a section of a discharge gap of a TSI. This example includes the first electrode 18, the second electrode 20, the insulating material 23 and the air gap 200. As previously discussed, if the air gap 200 did not exist, the initial breakdown point would occur at substantially the same location, i.e., the closest point of contact between the second electrode 20 and the insulating material 23. This leads to a rapid erosion of the second electrode 20 at that point and limits ignitor life. The air gap 200 helps to overcome this problem by varying the location of the initial discharge such that the second electrode 20 is not worn away (ablated) at the same point every discharge. This is shown graphically in FIG. 4 where an area of ablation 400 is of width $W_a$ and a height $H_a$. The first time the ignitor is fired, the initial breakdown will occur at the point when the two electrodes are closest to one another. At this time, some ablation of the electrode will occur causing that point to no longer be the closest point so, the next breakdown occurs at the "new" closest point (assuming a uniform gas mixture). Thus, the air gap 200 considerably expands the region over which the discharge occurs. When a thing ring of ablation is formed over the entire perimeter of the second electrode 20, the closest point will be slightly above or below this ring where a new discharge initiation region will be formed. This occurs during the entire life of the ignitor.

Eventually, the area of ablation, 400, is formed; the size of this area is large enough that the ignitor lasts for a commercially practicable time before the second electrode 20 is ablated away. The width of the air gap $W_{ag}$ is limited to being about one-half the width of the discharge gap $W_{dg}$ when, if this width is any larger, the effects of breakdown across the insulating material 23 may be lost due to an increase in resistance occasioned by the increase in space between the electrodes.

The area of ablation, 400, leads to another physical constraint for an ignitor according to one embodiment of the invention. In the case of concentric cylindrical electrodes, the inside of the second electrode 20 should be substantially smooth to ensure that the distance between the electrodes is substantially the same throughout the entire length of the discharge gap. Particularly, in the vicinity of the top of the air gap 200, no portion of the second electrode 20 should be any closer to the first electrode 18 than in any other area of the gap. A substantially smooth surface of the second electrode 20 allows for the ablation of the second electrode 20 to occur around the entire ablation area 400.

Currently, those conventional spark plugs which are concentric in nature and have a center electrode extending beyond a dielectric material have outer electrodes that are not suited to take advantage of the Lorentz force. In these conventional plugs, the bulk of the outer electrode is directed (at least to a certain degree) radially away from the center electrode. In order to generate Lorentz force on the plasma, the outer electrode must provide a return path for the electric current which is substantially parallel to the center electrode. Thus, in some embodiments, it may be desired to have the first and second electrodes arranged such that the facing sides of the electrodes remain substantially parallel at least in the initiation region. In other embodiments, the electrodes should be substantially parallel to one another throughout the length of the discharge gap. That is, the first and second electrodes should be parallel to one another from at least a region near the upper surface 204 to the ends of the electrodes. In other embodiments, the first and second electrodes may remain parallel to one another some distance below the upper surface 204. For instance, the first and second electrodes may remain parallel to one another a distance below the upper surface 204 which is approximately equal to the width of the discharge gap $W_{dg}$ or remain parallel to one another for a distance which represents any fraction between zero and one of the width of the discharge gap $W_{dg}$. It should be appreciated that the electrodes of any of the TSI embodiments disclosed herein may also be so arranged.

Referring again to the embodiment of FIG. 3B, there may exist another gap, the expand gap 202, between the insulating material 23 and the first electrode 18. The expand gap 202 has an initial width, We, when the TSI 17 is cold. In some embodiments, the expand gap 202 exists between the insulating material 23 and the first electrode 18 for substantially the entire length of the TSI 17. In other embodiments, the expand gap 202 may only exist in between the first electrode 18 and the dielectric material 23 for a few (e.g. .5—5) cm below the upper surface 204

One purpose of the expand gap 202 is to provide a space into which the first electrode 18 may expand as it heats up during operation. Without the expand gap 202 any expansion of the first electrode 18 could cause the insulating material 23 to crack. If the insulating material is cracked, its dielectric properties could be altered and thereby reduce the efficiency of the TSI. Further, the expand gap 202 helps to reduce the possibility of short circuits in a manner similar to that for the air gap 200. It should be understood however, that the embodiment shown in FIG. 3B could be implemented without the expand gap 202, if a more flexible/less brittle insulating material is discovered.

A TSI shown to work well has been made with an air gap width $W_{ag}$ of about 0.53 mm, an air gap depth $D_{ag}$ of about 5.00 mm and an expand gap width We of about 0.08 mm. These dimensions are implemented in a concentric electrode TSI similar to TSI 17 of FIG. 2 wherein the length of the first electrode 18 is about 2.7 mm, the length of the second electrode 20 is about 1.2 mm and the gap between them ($r_2$—$r_1$) is about 2.4 mm.

It should be understood that either or both the air gap and the expand gap discussed above may be utilized in any of the embodiments of a TSI discussed below.

Figure 5:
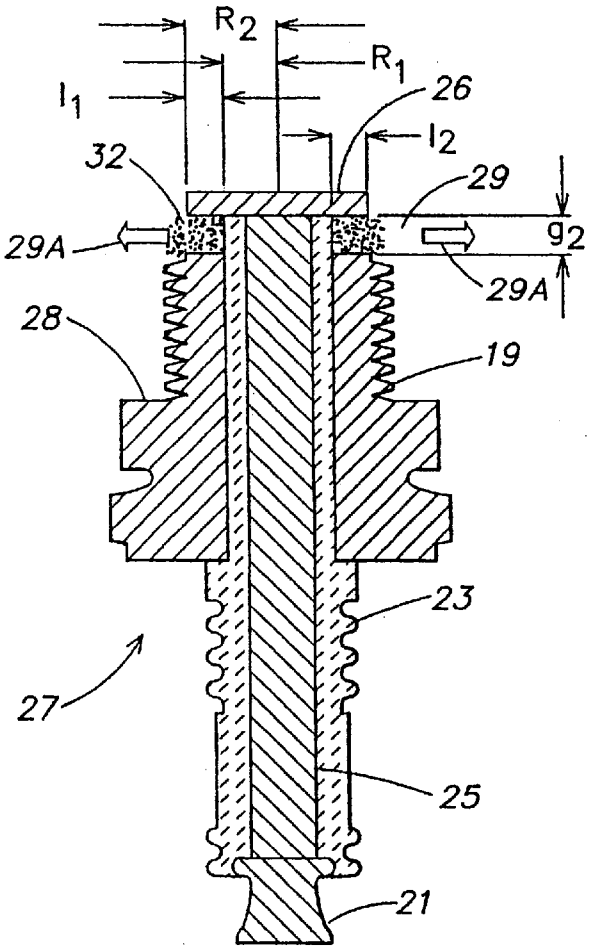
FIG. 5 is a cross-sectional view of a traveling spark ignitor for another embodiment of the invention wherein the plasma produced travels by expanding in the radial direction.

FIG. 5 is an example of another embodiment of a TSI according to the present invention. TSI 27 includes an internal electrode 25 that is placed coaxially within an external electrode 28. The space between the electrodes 25 and 28 is substantially filled with an insulating material 23 (e.g., ceramic). A difference between the embodiment in FIG. 5 and that in FIG. 2 is that there is a flat, disk-shaped (circular) electrode surface 26 formed integrally with, or attached to, the free end of the center electrode 25, extending transversely to the longitudinal axis of electrode 25 and facing electrode 28. Note further that the horizontal plane of disk 26 is parallel to the associated piston head (not shown) when the plasma ignitor 27 is installed in a piston cylinder. The end surface of electrode 28 which faces disk electrode 26 is a substantially flat circular shape extending parallel to the facing surface of electrode 26. As a result, an annular cavity 29 is formed between opposing surfaces of electrodes 26 and 28. More precisely, there are two substantially parallel surfaces of electrodes 26 and 28 spaced apart and oriented to be parallel to the top of an associated piston head, as opposed to the embodiment of FIG. 2 wherein the electrodes run perpendicularly to an associated piston head when in use. Consider that when the air/fuel mixture is ignited, the associated piston "rises" and is close to the spark plug or ignitor 27, so that it is preferably further from gap 29 of the ignitor 27 to the wall of the associated cylinder than to the piston head. The essentially parallel electrodes 26 and 28 are substantially parallel to the longest dimension of the volume of the combustible mixture at the moment of ignition, instead of being oriented perpendicularly to this dimension and toward the piston head as in the embodiment of FIG. 2, and the prior art. It was discovered that when the same electrical conditions are used for energizing ignitors 17 and 27, the plasma acceleration lengths l and L, respectively, are substantially equal for obtaining optimal plasma production. Also, for TSI 27, under these conditions the following dimensions work well: the radius of the disk electrode 26 is $R_2$=6.8 mm, the radius of the isolating ceramic is $R_1$=4.3 mm, the gap between the electrodes $g_2$=1.2 mm and the length L=2.5 mm.

In the illustrative embodiment of FIG. 5, the plasma 32 initiates in discharge gap 29 at the exposed surface of insulator 25, and grows and expands outwardly in the radial direction of arrows 29A. This may provide advantages over the TSI embodiment of FIG. 2. First, the surface area of the disk electrode 26 exposed to the plasma 32 is substantially equal to that of the end portion of the outer electrode 28 exposed to the plasma 32. This means that the erosion of the inner portion of disk electrode 26 can be expected to be significantly less than that of the exposed portion of inner electrode 18 of TSI 17 of FIG. 2, the latter having a much smaller surface area exposed to the plasma. Secondly, the insulator material 23 in TSI 27 provides an additional heat conducting path for electrode 26. The added insulator material 23 will keep the inner metal of electrodes 25, 26 cooler than electrode 18. In addition, in using TSI 27, the plasma will not be impinging on and perhaps eroding the associated piston head.

Figure 6:
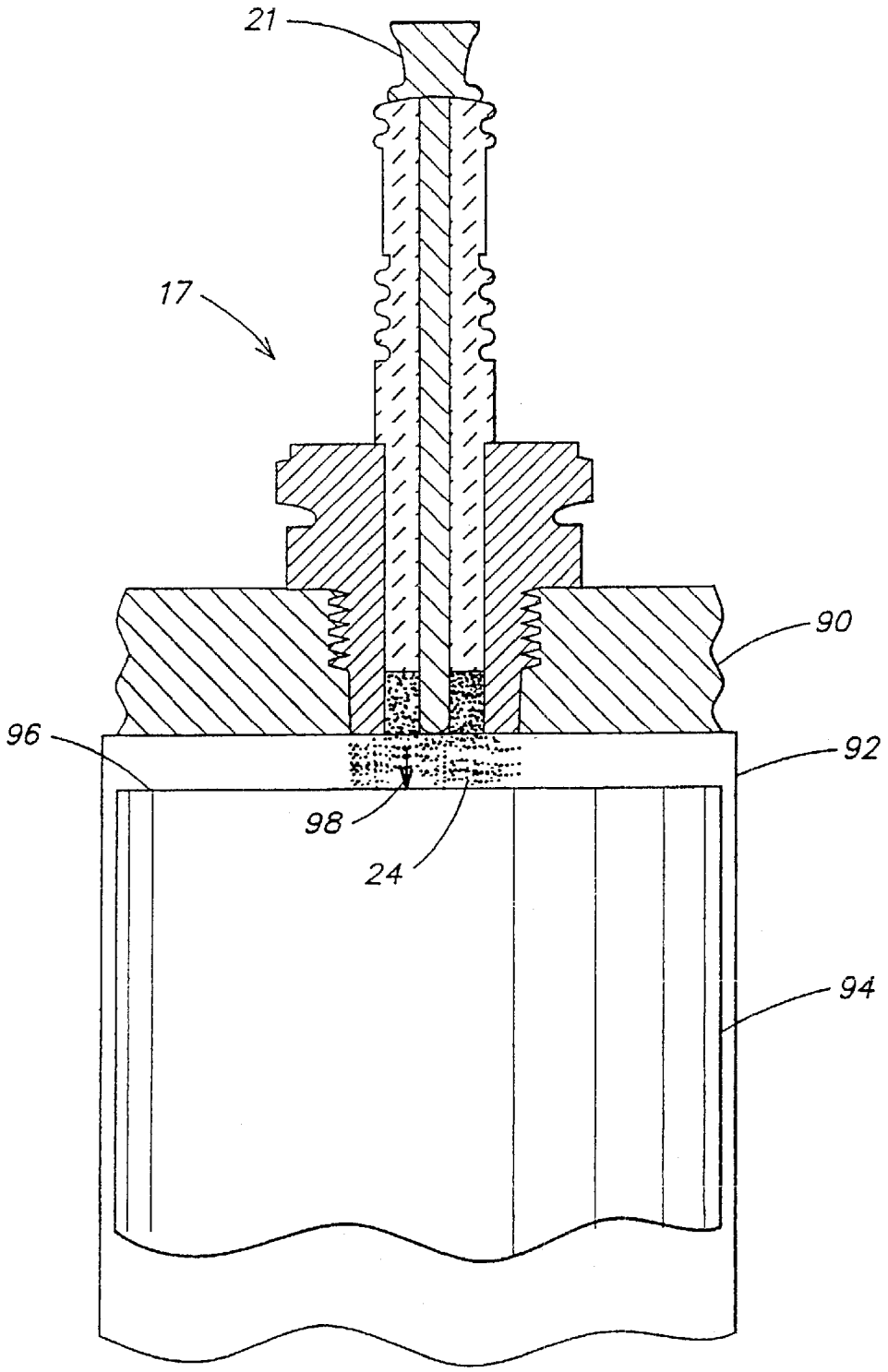
FIG. 6 is a cutaway pictorial view of a traveling spark ignitor for one embodiment of the invention, as installed into a cylinder of an engine.
Figure 7:
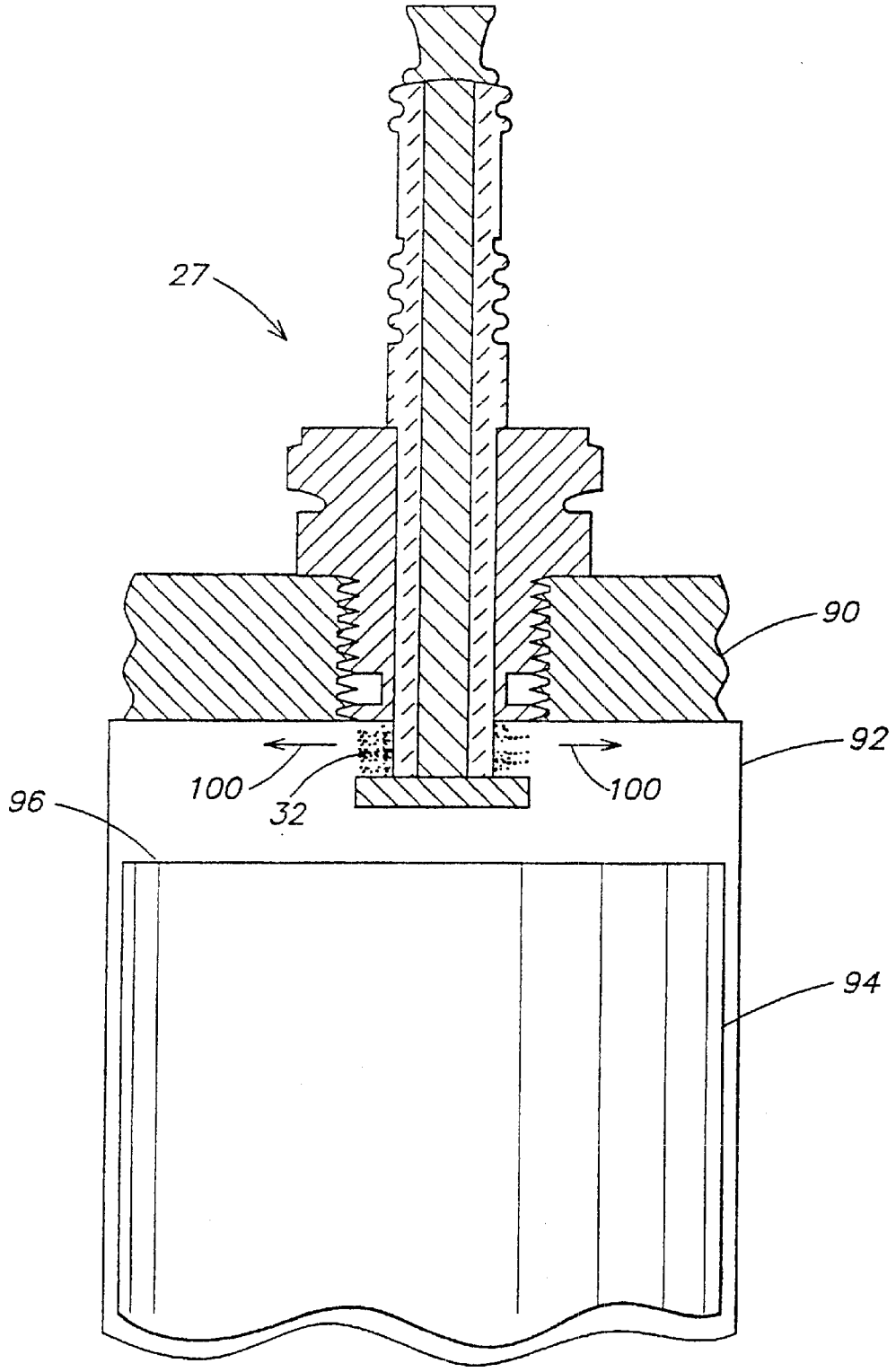
FIG. 7 is a cutaway pictorial view of a traveling spark ignitor for a second embodiment of the invention, as. installed into a cylinder of an engine.

FIGS. 6 and 7 illustrate pictorially the differences in plasma trajectories between TSI 17 of FIG. 2, and TSI 27 of FIG. 5 when installed in an engine. In FIG. 6, a TSI 17 is mounted in a cylinder head 90, associated with a cylinder 92 and a piston 94 which is reciprocating—i.e., moving up and down—in the cylinder 92. As in any conventional internal combustion engine, as the piston head 96 nears top dead center, the TSI 17 will be energized. This will produce the plasma 24, which will travel in the direction of arrow 98 only a short distance toward or to the piston head 96. During this travel, the plasma 24 will ignite the air/fuel mixture (not shown) in the cylinder 92. The ignition begins in the vicinity of the plasma 24. In contrast to such travel of plasma 24, the TSI 27, as shown in FIG. 7, provides for the plasma 32 to travel in the direction of arrows 100, resulting in the ignition of a greater amount of air/fuel mixture than provided by TSI 17, as previously explained.

Figure 8:
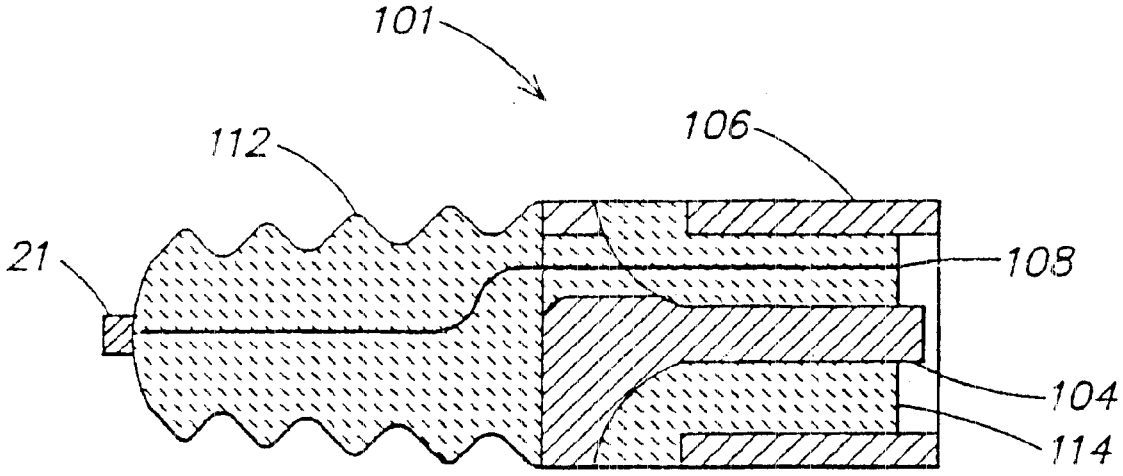
FIG. 8 shows a cross-sectional view of yet another traveling spark ignitor for an embodiment of the invention.

A trigger electrode can be added between the inner and outer electrodes of FIGS. 2 through 5 to lower the voltage required to cause an initial breakdown between the first and second electrodes. FIG. 8 shows such a three electrode plasma ignitor 101 schematically. Also shown in FIG. 8 is a simplified version of the electronics which may drive a TSI. An internal electrode 104 is placed coaxially within the external electrode 106, both having diameters on the order of several millimeters. Radially placed between the internal electrode 104 and the external electrode 106 is a third electrode 108. This third electrode 108 is connected to a high voltage (HV) coil 110. The third electrode 108 initiates a discharge between the two main electrodes 104 and 106 by charging the exposed surface 114 of the insulator 112. The space between all three electrodes 104, 106, 108 is filled with insulating material 112 (e.g., ceramic) except for the last 2–3 mm space between electrodes 104 and 106 at the combustion end of the ignitor 101. A discharge between the two main electrodes 104 and 106, after initiation by the third electrode 108, starts along the surface 114 of the insulator 112. The gas (air-fuel mixture) is ionized by the discharge. This discharge creates a plasma, which becomes a good electrical conductor and permits an increase in the magnitude of the current. The increased current ionizes more gas (air-fuel mixture) and increases the volume of the plasma, as previously explained.

The high voltage between the tip of the third electrode 108 and the external electrode 106 provides a low current discharge, which is sufficient to create enough charged particles on the surface 114 of the insulator 112 for an initial discharge to occur between electrodes 104 and 106.

Figure 9A:
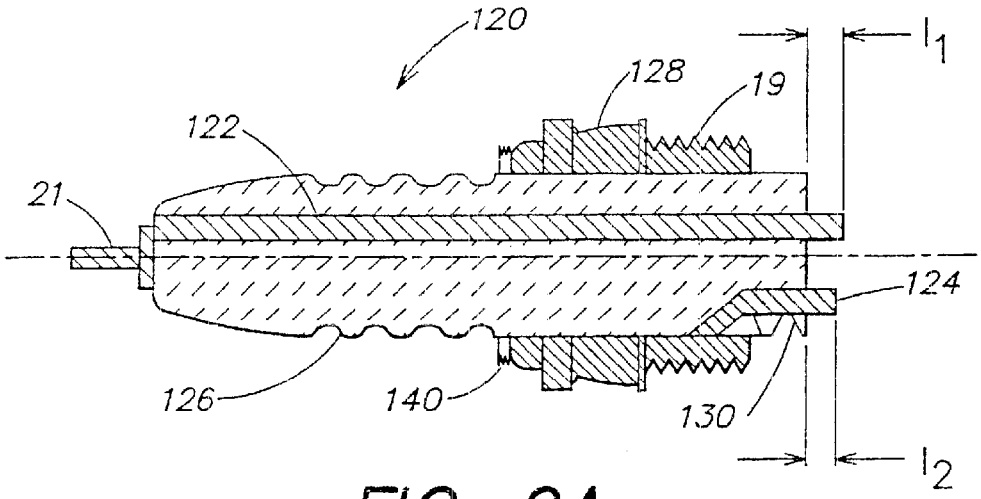
FIG. 9A shows a longitudinal cross-sectional view of another traveling spark ignitor for another embodiment of the invention.
Figure 9B:
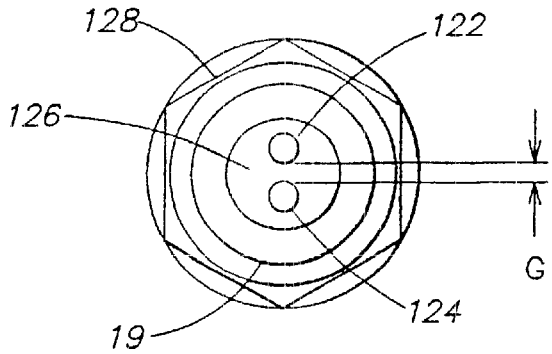
FIG. 9B is an end view of the traveling spark ignitor of FIG. 9A showing the free ends of opposing electrodes.
Figure 9C:
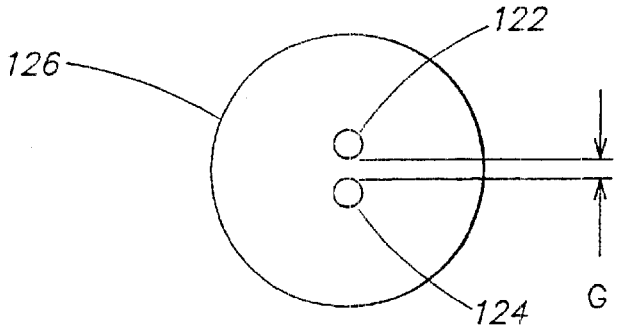
FIG. 9C is an enlarged view of a portion of FIG. 9B.

As shown in FIGS. 9A, 9B and 9C, another embodiment of the invention includes a TSI 120 having parallel rod-shaped electrodes 122 and 124. The parallel electrodes 122, 124 have a substantial portion of their respective lengths encapsulated by dielectric insulator material 126, as shown. A top end of the dielectric 126 retains a spark plug boot connector 21 that is both mechanically and electrically secured to the top end of electrode 122. The dielectric material 126 rigidly retains electrodes 122 and 124 in parallel, and a portion rigidly retains the outer metallic body 128 having mounting threads 19 about a lower portion, as shown. Electrode 124 is both mechanically and electrically secured to an inside wall of metallic body 128 via a rigid mount 130, as shown, in this example. As shown in FIG. 9A, each of the electrodes 122 and 124 extends a distance $l_1$ and 12, respectively, outwardly from the surface of the bottom end of dielectric 126.

With reference to FIGS. 9B and 9C, the electrodes 122 and 124 may be parallel rods that are spaced apart a distance G, where G is understood to represent the width of the discharge gap between the electrodes 122, 124 (see FIG. 9C).

It has been discovered that, while operating a TSI as described above, a great deal of RF noise may be generated. During the initial high voltage breakdown, current flows in one direction through a first electrode and in another through a second electrode. These opposite flowing currents generate the RF noise. In conventional spark plugs this is not an issue because a resistive element may be placed within the plug in the incoming current path. However, due to the large currents experienced during the high current stage of operation of the present invention, such a solution is not feasible because such a resistor would not allow enough current to flow to generate a large plasma kernel.

Such RF noise may interfere with various electronic devices and may violate regulations if not properly shielded. As such, and referring again to FIG. 9A, the TSI 120 may also include a co-axial connector 140 for attaching a co-axial cable (not shown) to the TSI 120. The co-axial connector 140 may be threads, a snap connection, or any other suitable connectors for attaching a co-axial cable to an ignitor. It should be understood that while not illustrated in the above embodiment, such a co-axial connector 140 could be included in any of the above embodiments. Furthermore, the co-axial connector 140 may be included in any semi-surface ignitor currently available or later produced. Cables of this sort will typically provide electricity to the boot connector 21, surround the dielectric 126 and mate with the body 128 to provide a ground. The cable should be able to withstand high voltages (during the primary discharge), carry a high current (during the secondary discharge) and survive the hostile operating environment in an engine compartment. One suitable co-axial cable is a RG-225 Teflon co-axial cable with a double braided shield. Other suitable cables include those disclosed in PCT Published application WO 98/10431, entitled High Power Spark Plug Wire, filed Sep. 7, 1997, which is hereby incorporated by reference.

III. The Firing Circuitry

The following description will focus on various embodiments of the firing circuitry which may lead to effective utilization of the plasma-generating devices disclosed above. It should be appreciated that the application of the firing circuitry electronics disclosed below are applicable to other types of spark plugs as well.

Figure 10:
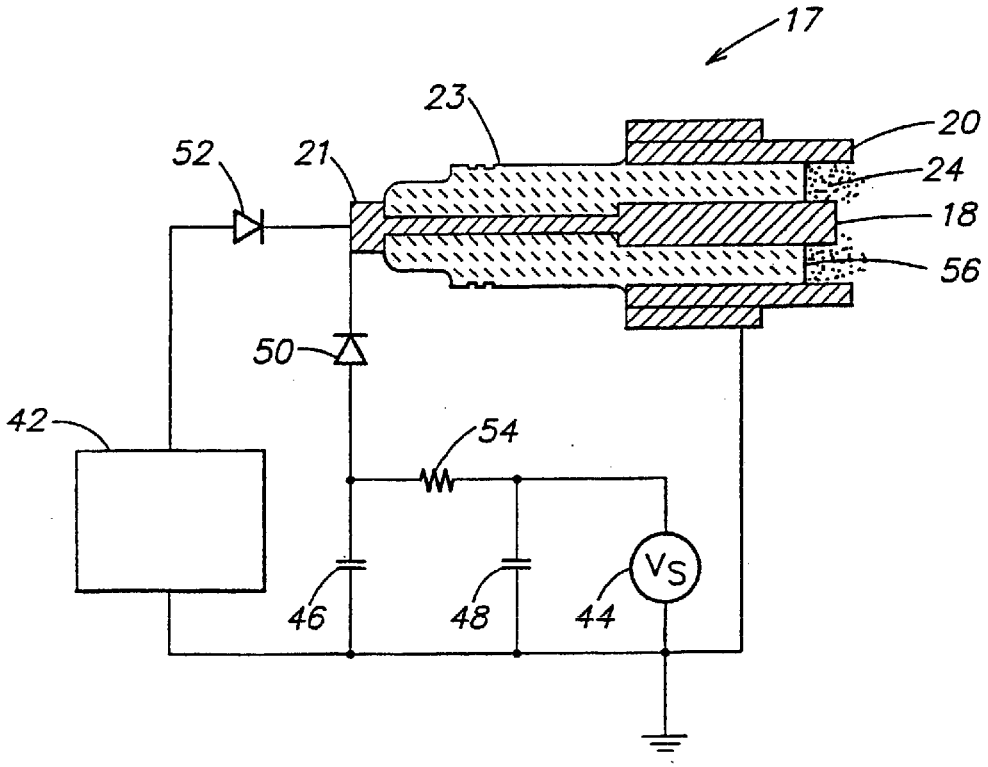
FIG. 10 is an illustration of the ignitor embodiment of FIG. 2 coupled to a schematic diagram of an exemplary electrical ignition circuit to operate the ignitor, according to an embodiment of the invention.

FIG. 10 shows a TSI 17 with a schematic of the basic elements of an electrical or electronic ignition circuit connected thereto, which supplies the voltage and current for the discharge (plasma). (The same circuitry and circuit elements may be used for driving any embodiment of a TSI disclosed herein or later discovered.) A discharge between the two electrodes 18 and 20 starts along the surface 56 of the dielectric material 23. The gas air/fuel mixture is ionized by the discharge, creating a plasma 24 which becomes a good conductor of current and permits current between the electrodes at a lower voltage than that which initiated the plasma. This current ionizes more gas (air/fuel mixture) and increases the volume of the plasma 24.

As shown, the discharge travels from first electrode 18 to the second electrode 20. One of ordinary skill would realize that the polarity of the electrodes could be reversed. However, there are advantages to having the discharge travel from the first electrode 18 to the second electrode 20. Physical constraints, namely the fact that the second electrode 20 surrounds the first electrode 18 in this embodiment, allow for the second electrode 20 to have a greater total surface area. The greater the surface area of an electrode the more resistant to ablation the electrode is. Having the second electrode 20 be the target of the positive ion bombardment, because of its greater resistance to ablation, allows for the production of a TSI 17 having a longer useful life.

The electrical circuit shown in FIG. 10 includes a conventional ignition system 42 (e.g., capacitive discharge ignition (CDI) or transistorized coil ignition (TCI)), a low voltage ($V_s$) supply 44, capacitors 46 and 48 diodes 50 and 52, and a resistor 54. The conventional ignition system 42 provides the high voltage necessary to break down, or ionize, the air/fuel mixture in the discharge gap along the surface 56 of the dielectric material 23 17. Once the conducting path has been established, the capacitor 46 quickly discharges through diode 50, providing a high power input, or current, into the plasma 24. The diodes 50 and 52 electrically isolate the ignition coil (not shown) of the conventional ignition system 42 from the relatively large capacitor 46 (between 1 and 4 $\mu$F). If the diodes 50, 52 were not present, the coil would not be able to produce a high voltage, due to the low impedance provided by capacitor 46. The coil would instead charge the capacitor 46. The function of the resistor 54, the capacitor 48, and the voltage source 44 is to recharge the capacitor 46 after a discharge cycle. The use of resistor 54 is one way to prevent a low resistance current path between the voltage source 44 and the spark gap of TSI 17.

Figure 11:
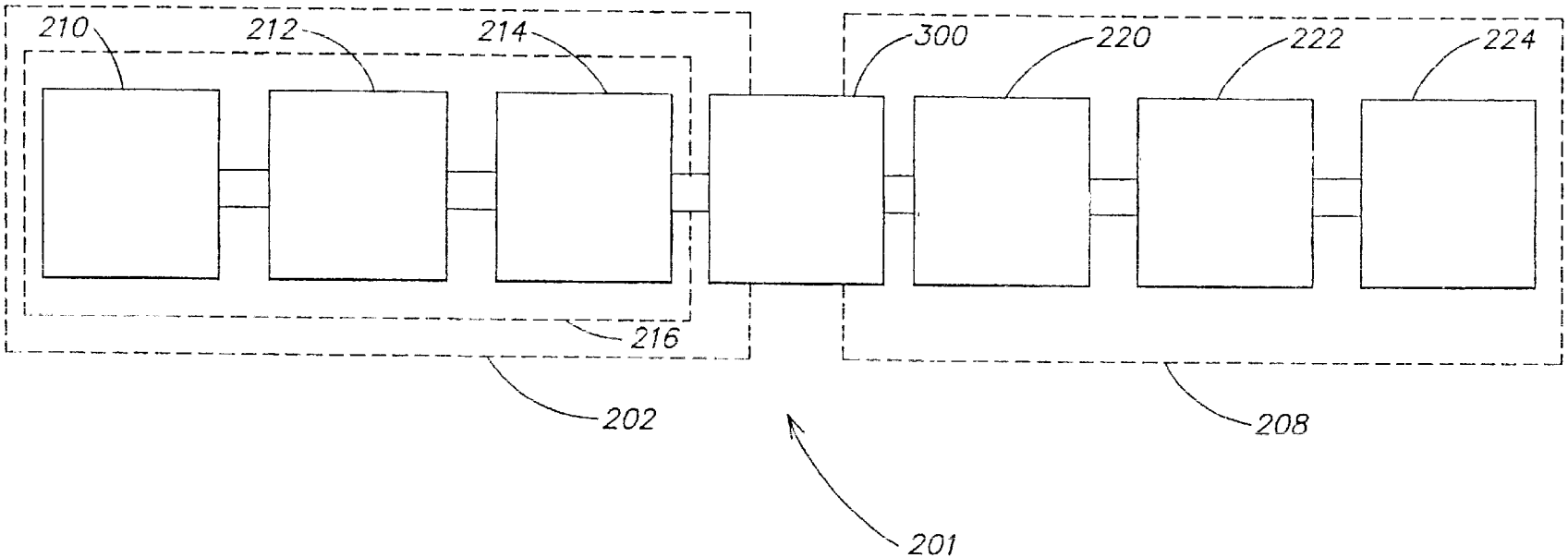
FIG. 11 is a high-level block diagram of an ignition circuit according to one embodiment of the present invention.

FIG. 11 is a high level block diagram of one illustrative embodiment of a firing circuit 200 according to the present invention. The circuit of this embodiment includes a primary circuit 202, an ignition coil 300, and a secondary circuit 208.

In one embodiment, the primary circuit 202 includes a power supply 210. The power supply 210 may be, for example, a DC to DC converter with an input of 12 volts and an output of 400–500 volts. In other embodiments, the power supply 210 could be an oscillating voltage source. The primary circuit 202 may also include a charging circuit 212 and a coil driver circuit 214. The charging circuit charges a device, such as a capacitor (not shown), in order to supply the coil driver circuit 214 with a charge to drive the ignition coil 300. In one embodiment, the power supply 210, the charging circuit 212, and the coil driver 214 may be a CDI circuit. However, it should be understood that these three elements could be combined to form any type of conventional ignition circuit capable of causing a discharge between two electrodes of a spark plug, for example, a TCI system. The coil driver circuit 214 is connected to a low voltage winding of the ignition coil 300. The high voltage winding of the ignition coil 300 is electrically coupled to the secondary circuit 208.

In the embodiment of FIG. 11, the secondary circuit 208 includes a spark plug and associated circuitry 220, a secondary charging circuit 222, and a power supply 224. The spark plug and associated circuitry 220 may include a capacitor (not shown) which is used to store energy in the secondary circuit 208. The two power supplies, 210 and 224, for the primary and secondary circuits, 202 and 208, respectively, may be derived from a single power source. It should be appreciated that the term "spark plug" as used in relation to the following firing circuitry may refer to any plug capable of producing a plasma, such as the plasma-generating and plasma expelling devices described above.

Figure 12:
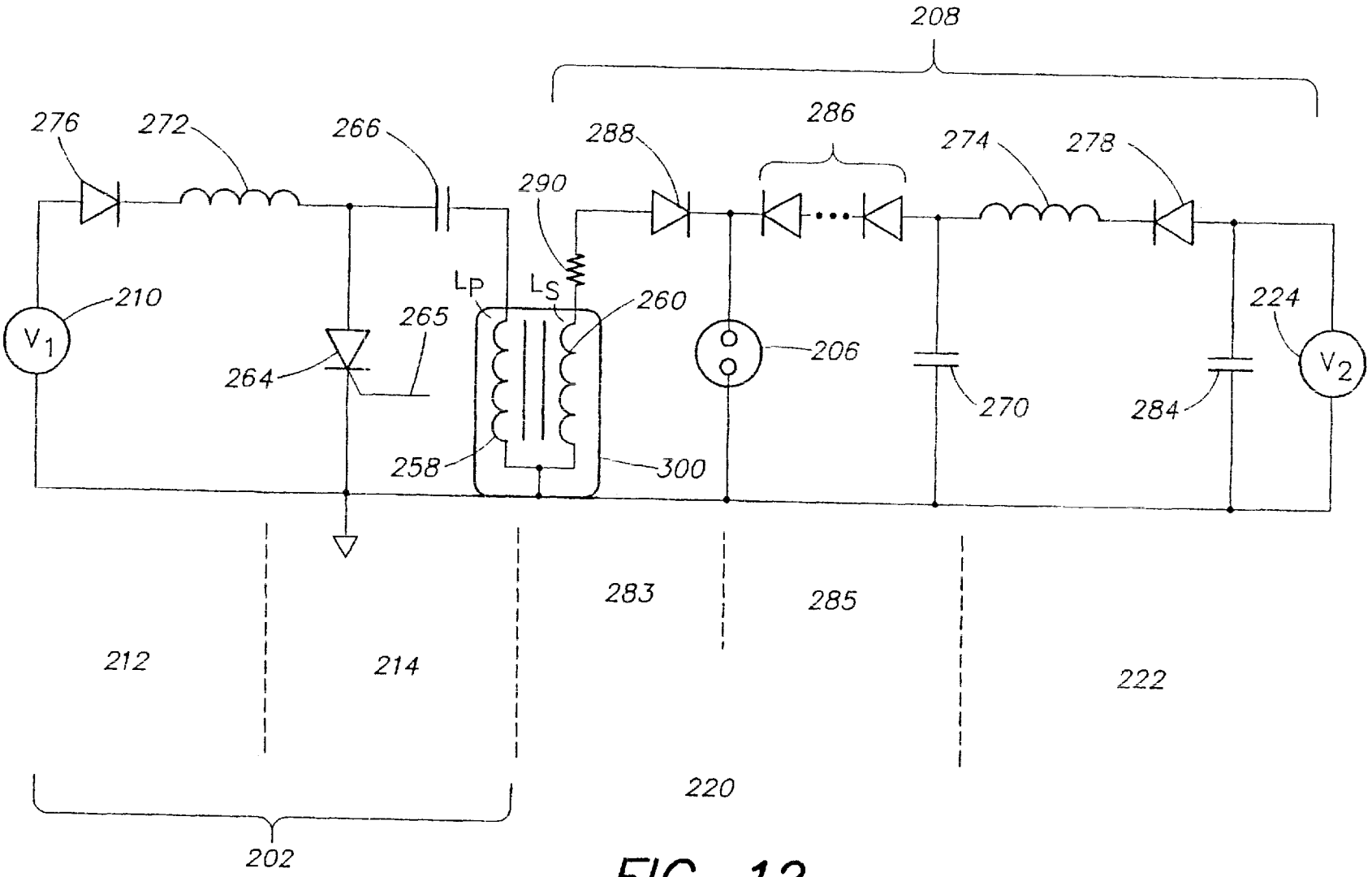
FIG. 12 shows a circuit schematic diagram of another ignition circuit embodiment according to the invention.

FIG. 12 is a more detailed version of the circuit described above in relation to FIG. 10. In a commercial application, the circuit of FIG. 12 is preferred for recharging capacitor 46 (FIG. 10) in a more energy-efficient manner, using a resonant circuit.

Furthermore, the conventional ignition system 42 (FIG. 10), whose sole purpose is to create the initial breakdown, is modified so as to use less energy and to discharge more quickly than has been conventional. Almost all of the ignition energy is supplied by capacitor 46 (FIG. 10). The modification is primarily to reduce high voltage coil inductance by the use of fewer secondary turns. This is possible because the initiating discharge can be of a much lower voltage when the discharge occurs over an insulator surface. The voltage required can be about one-third that required to cause a gaseous breakdown in air for the same distance.

Matching the electronic circuit to the parameters of the TSI (length of electrodes, diameters of coaxial cylinders, duration of the discharge) maximizes the volume of the plasma when it leaves the TSI for a given store of electrical energy. By choosing the parameters of the electronic circuit properly, it is possible to obtain current and voltage time profiles that transfer substantially maximum electrical energy to the plasma.

The ignition electronics can be divided into four parts, as shown: the primary and secondary circuits, 202 and 208, respectively, and their associated charging circuits, 212 and 222, respectively. The primary circuit 202 also includes a coil driver circuit 214. The secondary circuit 208 may include spark plug and associated electronics circuitry 220 which may be broken down into a high voltage section 283, and a low voltage section 285.

The primary and secondary circuits, 202 and 208, respectively, correspond to primary 258 and secondary 260 windings of an ignition coil 300. When the SCR 264 is turned on via application of a trigger signal to its gate 265, the capacitor 266 discharges through the SCR 264, which causes a current in the coil primary winding 258. This in turn imparts a high voltage across the associated secondary winding 260, which causes the gas in a region near the spark plug 206 to break down and form a conductive path, i.e. a plasma. Once the plasma has been created, diodes 286 turn on and the secondary capacitor 270 discharges.

After the primary and secondary capacitors 266 and 270, respectively, have discharged, they are recharged by their respective charging circuits 212 and 222. Both charging circuits 212 and 222 incorporate an inductor 272, 274 (respectively) and a diode 276, 278 (respectively), together with a power supply 210, 224 (respectively). The function of the inductors 272 and 274 is to prevent the power supplies from being short-circuited through the spark plug 206. The function of the diodes 276 and 278 is to avoid oscillations. The capacitor 284 prevents the power supply 224 voltage $V_2$ from the going through large fluctuations.

The power supplies 210 and 224 both supply on the order of 500 volts or less for voltages $V_1$ and $V_2$, respectively. They could be combined into one power supply. Power supplies 210 and 224 may be DC-to-DC converters from a CDI (capacitive discharge ignition) system, which can be powered by a 12-volt automobile electrical system, for example.

The high current diodes 286 connected in series have a high total reverse breakdown voltage, larger than the maximum spark plug breakdown voltage of any of the above disclosed plasma-generating devices, for all engine operating conditions. The function of the diode 286 is to isolate the secondary capacitor 270 from the ignition coil 300, by blocking current from secondary winding 260 to capacitor 270. If this isolation were not present, the secondary voltage of ignition coil 300 would charge the secondary capacitor 270; and, given a large capacitance, the ignition coil 300 would never be able to develop a sufficiently high voltage to break down the air/fuel mixture in a region near the spark plug 206.

Diode 288 prevents capacitor 270 from discharging through the secondary winding 260. Finally, the optional resistor 290 may be used to reduce current through secondary winding 260, thereby reducing electromagnetic radiation (radio noise) emitted by the circuit.

Figure 13:
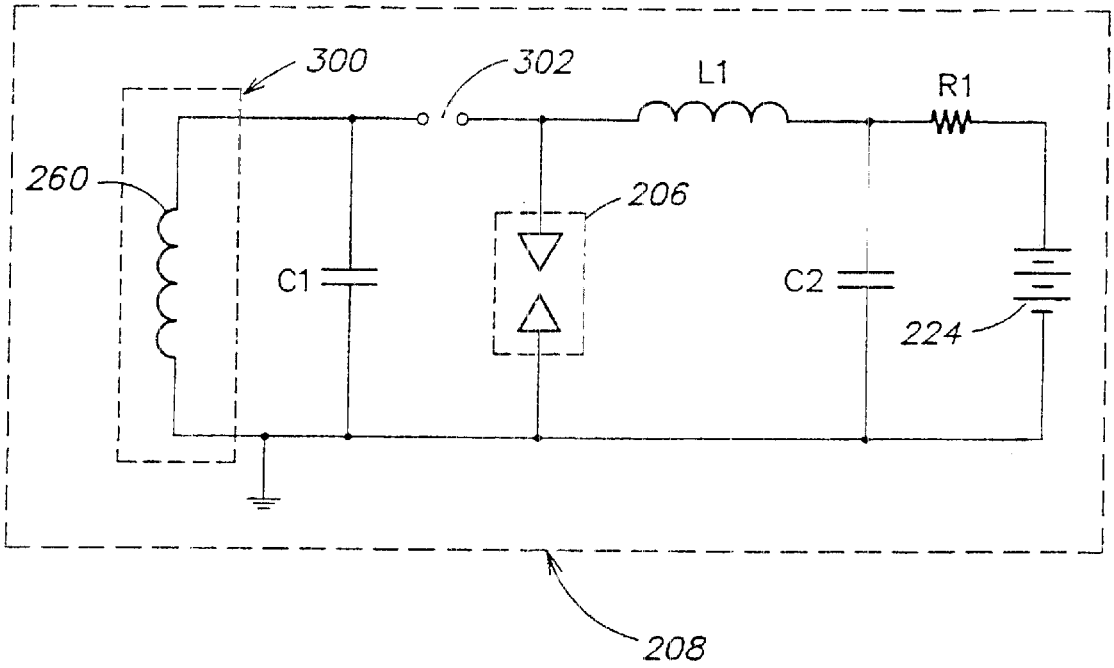
FIG. 13 shows one embodiment of the secondary electronics of FIG. 11.

FIGS. 13–15 detail general various alternative secondary circuits 208 which may be used according to the present invention.

FIG. 13 shows an example of one embodiment of a secondary circuit 208 according to the present invention. This circuit provides for a fast initial breakdown across the spark plug 206 followed by a slow follow-on current between the electrode of the spark plug 206 due to the inductor L1. As such, this circuit may be thought of as a "fast-slow" circuit.

The secondary (high voltage) winding 260 of the ignition coil 300 receives electrical energy from the primary circuit (not shown), which is attached to the low side winding (not shown) of the ignition coil 300, in order to charge capacitor C1 which is connected in parallel with the ignition coil 300. When the voltage across the capacitor C1 becomes large enough to cause a breakdown over both the spark gap 302 and between the electrodes of the spark plug 206, the capacitor C1 is discharged through the spark gap 302 and the spark plug 206. The capacitor C1 is prevented from discharging into capacitor C2 by inductor L1 which acts as a large resistance to a rapidly changing current.

This initial breakdown caused by the discharge of capacitor C1 is the initial phase which begins the formation of a plasma kernel between the electrodes of the spark plug.

It should be understood that the spark gap 302 could be replaced by a diode or other device capable of handling the high voltage across the secondary winding 260 and blocking a large current from discharging into the secondary winding 260. From time to time in the following description and in the attached figures, the spark gap 302 will be described and shown as a diode to illustrate their theoretical interchangeability for certain analytical purposes.

Before the initial breakdown occurs, the capacitor C2 is charged by the power supply 124. The power supply 224 is sized such that it does not create a large enough voltage across capacitor C2 in order to cause a breakdown across the spark plug 206. After the capacitor C1 has started to discharge through the spark plug 206, capacitor C2 then discharges through the spark plug 206. This discharge is a lower voltage, higher current discharge than that provided by the discharge of capacitor C1. The capacitor C2 is prevented from discharging through the secondary coil 260 by the spark gap 302. As discussed above, the spark gap 302 could be replaced by a diode capable of enduring the high voltage across capacitor C1 and blocking the high current discharge of capacitor C2 from traveling to the secondary winding 260 and while still allowing for a fast discharge (e.g., a break-over diode or self-triggered SCR). The discharge of capacitor C2 through the spark plug 206 is the follow-on low-voltage, high-current pulse which causes the plasma kernel to expand and be swept out from between the electrodes of the spark plug 206 as described above.

The discharge of capacitor C2 through the spark plug 206 is slower than the discharge of capacitor C1. The reason that the discharge is slower is due to the inductor L1, which serves to slow down the rate which capacitor C2 may discharge through the spark plug 206. In one embodiment, capacitor C2 is larger than capacitor C1 and, as is known in the art, its discharge is thus slower.

Resistor R1 serves as a current limiting resistor so that the power supply does not provide a continuous current through the spark plug 206 after capacitor C2 has discharged and limits the charging current to capacitor C2. It should be appreciated that the connection between resistor R1 and the power supply 224 is the Thevenin equivalent of a current limited power supply. It should also be appreciated that resistor R1 could be replaced with a suitably sized inductor to prevent a continuous current from the power supply 224 from persisting through the spark plug 206 and limits the charging current of capacitor C2. The combination of resistor R1 and power supply 224 may from time to time be referred herein to generally as a secondary charging circuit.

Suitable values for the components described in relation to FIG. 13 include C1=200 pF, L1=200 $\mu$H, C2=2 $\mu$f, and R1=2 K ohms, when power supply 224 provides 500 V.

FIGS. 14A–14C show various circuit schematics for different variations of the primary circuit. All of them use a capacitor 620 which is charged by the primary charging circuit 212 through the coil primary winding 258. All of the embodiments shown in FIGS. 14A–14C also include an SCR 264 which is used to rapidly discharge the capacitor 620 through winding 258, which creates the high voltage on the secondary winding 260. The three circuits have diode 622 in different places.

FIG. 14A has the SCR 264 in parallel with the primary winding 258. Once the capacitor 620 is completely discharged and begins to recharge in the opposite polarity, the diode 264 becomes conductive, and a current through the primary winding 258 continues through the diode 622 until it is dissipated by the resistances of the primary winding and the diode, 258 and 622 respectively, and the energy transfer to the secondary winding. Thus the coil current and secondary voltage (high voltage) do not change polarity.

FIG. 14B has the diode connected in parallel to the SCR 264. When the SCR 264 fires, the capacitor 620 discharges, and then recharges in the opposite polarity due to the inductance of the primary coil 258. Once the capacitor 620 is charged to the maximum voltage, the current reverses, passing through the diode 622. This cycle is then repeated until all of the energy is dissipated. The coil current and high voltage thus oscillate.

The circuit of FIG. 14C is designed to give a single pass of current through the primary winding 258, recharging the capacitor 620 in the opposite direction. The second pass of current in the opposite direction then occurs through the diode 622 and the inductor 624 (which are connected in series between the cathode of the SCR 264 and ground), at a slower rate, so that the capacitor is recharged after the spark in the spark plug (not shown) has been extinguished. The diode 622 and inductor 624 function as an energy recovery circuit.

Figure 15A:
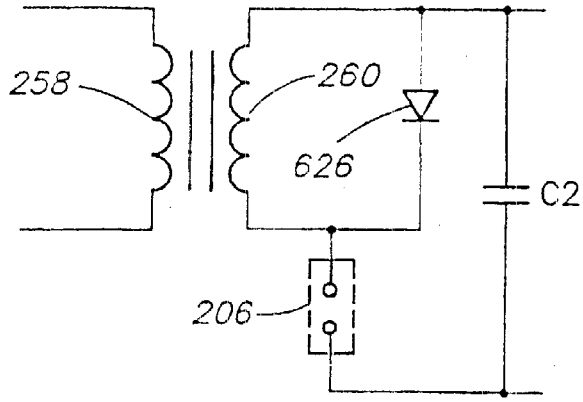
FIGS. 15A–15C show alternative embodiments of the secondary electronics of FIG. 11.
Figure 15B:
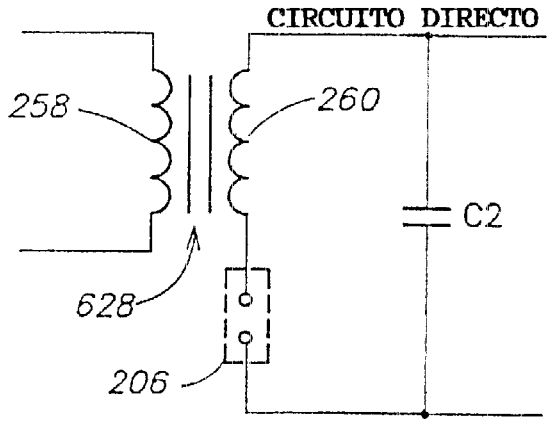
Figure 15C:
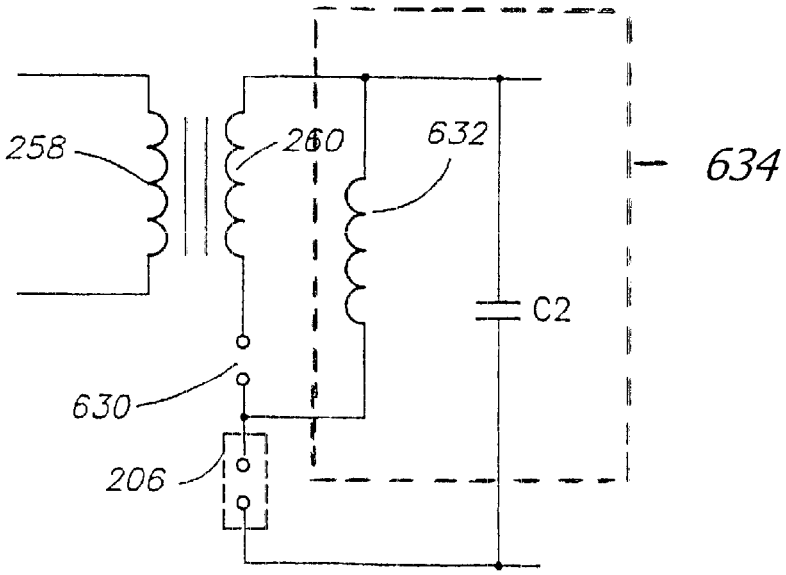

FIGS. 15A–15C show further embodiments of the secondary circuit 208. The embodiments shown in FIGS. 15A–15C include the spark plug and associated circuitry 220 (FIG. 11).

The embodiment of FIG. 15A includes a single diode 626. It should be appreciated that diode 626 could be replaced by a plurality of series connected diodes. The diode 626 provides a low impedance path for the capacitor 626 to discharge. In this embodiment it is preferably that the two windings, 258 and 260, be completely separated.

FIG. 15B is an example of a thru-circuit. This embodiment includes the capacitor C2 which discharges through the secondary winding 260. Ordinarily this would result in a very slow discharge due to the large inductance of the secondary winding 260. However, if the coil core 628 saturates, dramatically reducing the coil inductance, then the discharge can occur more rapidly.

FIG. 15C shows another embodiment of a secondary circuit. In this embodiment, the inductor 632 is in a parallel arrangement with the second winding 260. The spark gap 630 is in series between the secondary winding 260 and the spark plug 206.

In the above described embodiments, the nature of the discharge may be described as being of a dual-stage nature. However, in some situations it may be desirable to add a third stage to the discharge. It has been discovered that an initial high-current burst may be required to allow the current channel to begin moving away from the upper surface of the dielectric material between the electrodes of a plasma-generating device. However, if this initial high-current burst delivers the energy too quickly, the plasma may not move for a long enough time to create a large kernel. That is, if the current is large enough to create a Lorentz force sufficient to cause the spark to travel, such a current may discharge all of the stored energy to quickly to allow the spark to travel far enough to generate an enlarged plasma kernel. Furthermore, large currents lead to increased electrode ablation. These drawbacks may be alleviated by lengthening the discharge or lowering the amount of current for a given discharge. However, if the current is reduced to achieve a longer discharge, the resultant Lorentz force may not be strong enough to cause the spark to move away from the location when the spark originated (e.g., the upper surface of the dielectric). The following examples discuss various circuits which overcome these problems, and others, by combining the initial breakdown with a fast high-current discharge to get the spark moving and longer lower-current discharge to grow the plasma kernel while minimizing electrode ablation.

Figure 16:
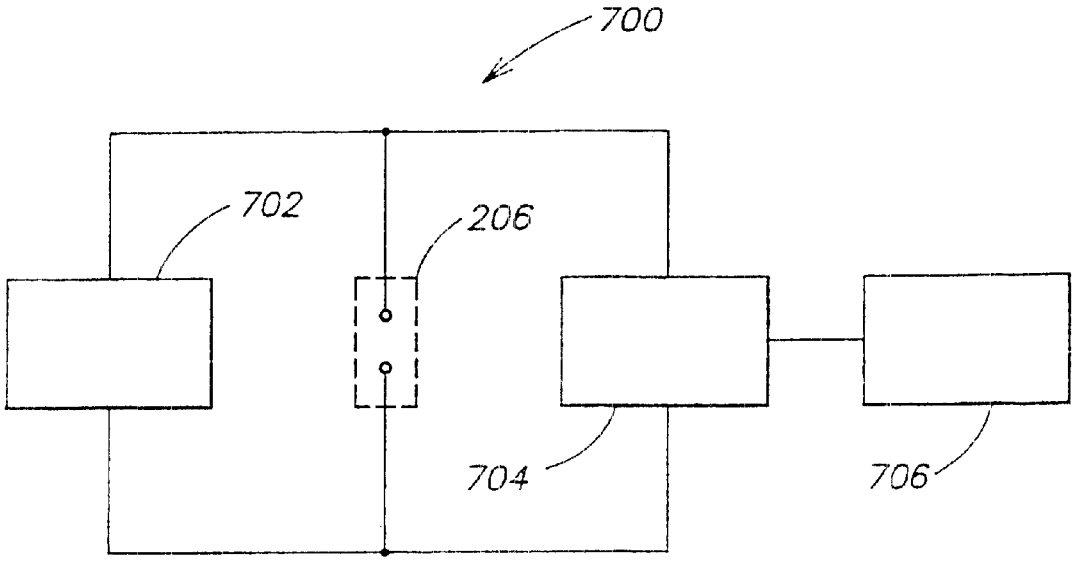
FIG. 16 shows a high-level block diagram of an electrical ignition circuit of the present invention.

FIG. 16 shows an example what shall be referred to herein as a parallel three circuit ignition system 700. This system includes a conventional high-voltage circuit 702, a secondary circuit 704 and a third circuit 706. The high-voltage circuit 702 and the secondary 704 circuit are connected in parallel with the spark plug 206. The parallel connection is similar to those described above. The high-voltage circuit 702 may be any conventional ignition circuit such as a CDI circuit, a TCI circuit or a magneto ignition system. The high-voltage circuit 702 provides the initial high voltage to ionize the air/fuel mixture in the discharge gap of a plasma-generating device. In the following examples, it should be understood that the high voltage circuit includes both the primary and secondary windings of the ignition coil. The secondary circuit 704 provides the follow-on current that serves to expand the plasma kernel. The embodiment of FIG. 16 also includes a third circuit 706 connected to the secondary circuit 704. In some embodiment, the third circuit 706 may be a sub-circuit of the secondary circuit 704. The third circuit 706 provides an initial pulse of current during the follow-on current which enables the initial current channel (and the surrounding plasma) to move away from the upper surface of the dielectric.

Figure 17:
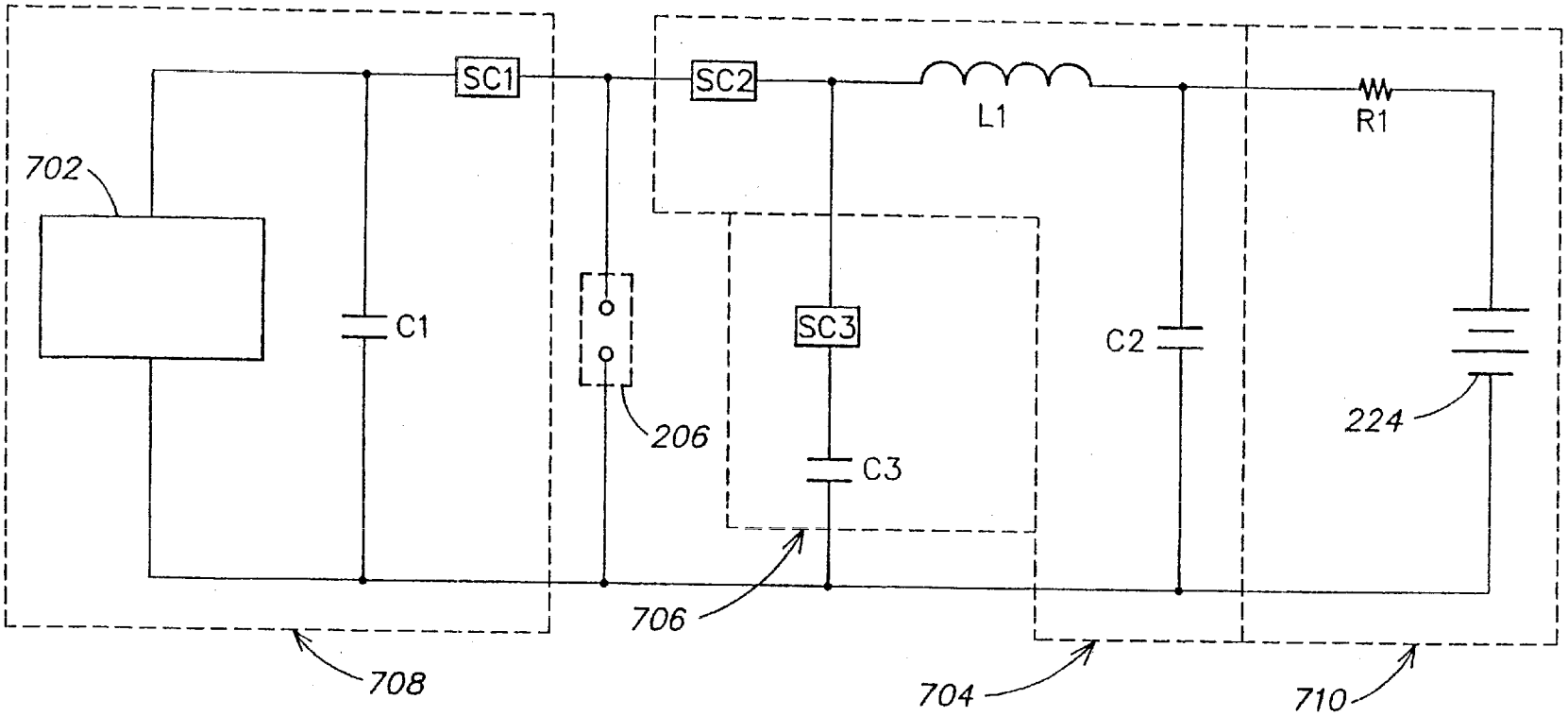
FIG. 17 is a more detailed version of the circuit disclosed in FIG. 16.

FIG. 17 shows a more detailed example of the circuit shown in FIG. 16. This circuit includes a high-voltage circuit 702, secondary circuit 704 and the third circuit 706.

Connected in parallel with the high-voltage circuit 702 is the first capacitor C1. The function of the first capacitor C1 is to enhance the initial spark between the electrodes of the spark plug 206 by providing a rapid, high-voltage discharge. In some embodiments, the first capacitor C1 may be omitted. For purposes of this discussion, the combination of capacitor C1 and high-voltage circuit should be called the primary circuit 708.

The primary circuit 708 may also include a first sub-circuit SCI connected between the capacitor C1 and the spark plug 206. The first sub-circuit SCI may be any device capable of preventing the capacitors of the second circuit 704 and the third circuit 706 from discharging into the first capacitor C1 after capacitor C1 has discharged. An additional feature of the first sub-circuit SCI may be to reduce the rise time of the high voltage. Suitable elements that may be used for the first sub-circuit SC1 include, but are not limited to, diodes, bread-over diodes and spark gaps.

The secondary circuit 704 includes a second capacitor C2, and inductor L1, and the second sub-circuit SC2. Attached to the second circuit 704 is the secondary charger 710 which include resistor R1 and voltage supply 224.

The inductor L1 serves to slow down the discharge of the second capacitor C2. As discussed below, this allows for the desired three stage voltage to produce increased plasma growth. The second sub-circuit SC2 serves to isolate the secondary circuit 704 from the high voltage created in the primary circuit 708 to both protect the secondary circuit 704 as well as to provide a high impedance to force the primary circuit 708 to generate a high enough voltage to cause an initial breakdown between the electrodes of the spark plug 206. To this end, the second sub-circuit SC2 may be a high voltage diode or an inductor.

The third circuit 706 includes a third capacitor C3 connected in parallel with the spark plug 206. The third circuit 706 may optionally also include a third sub-circuit SC3. The third capacitor C3 provides an initial pulse of current, which allows the plasma to move away from the region of the initial breakdown. The optional third sub-circuit SC3 may be used to prevent the rapid recharging of the third capacitor C3. If the third sub-circuit SC3 is omitted, the third capacitor C3 may form an oscillatory circuit with the second capacitor C2 and the inductor L1. Possible implementation of the third sub-circuit SC3 include, but are not limited to, a diode connected in parallel with either an inductor or a resistor or just a single diode. Of course, the diode would be connected such that its anode is connected to the third capacitor C3 and its cathode is connected to the inductor L1.

Figure 18:
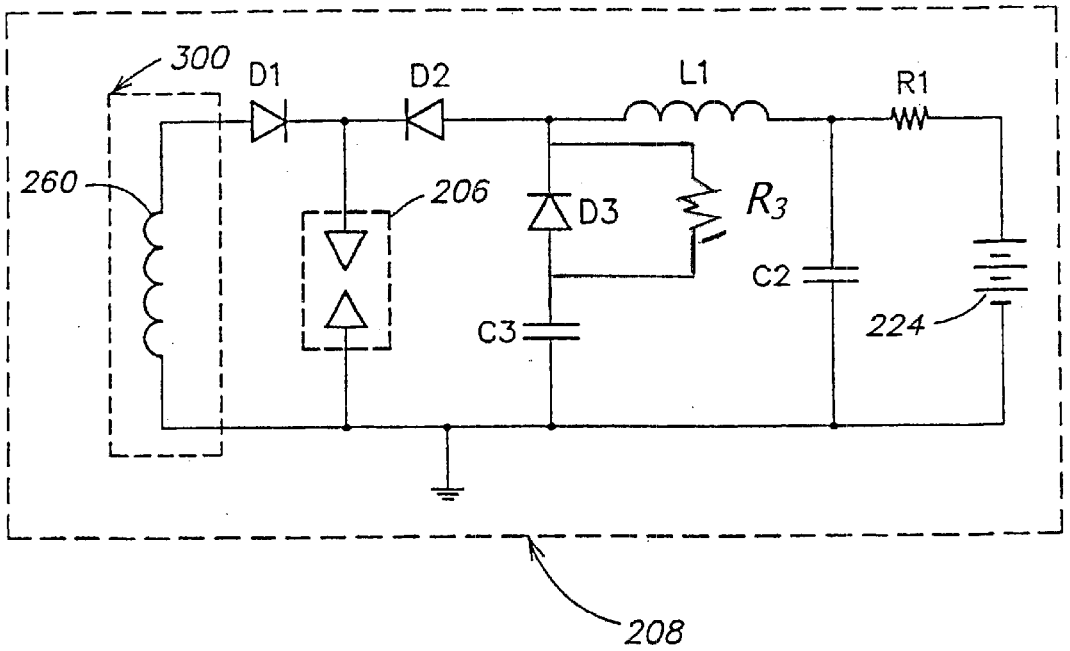
FIG. 18 is a more detailed version of the secondary circuit disclosed in FIG. 17.

FIG. 18 shows another embodiment of a secondary circuit 208. This circuit provides an initial "snap" high voltage across the spark plug 206 followed by a first high current discharge and a slower discharge. FIG. 18 will be used to further explain the operation of a three stage circuit. As discussed above, the high-voltage circuit (not shown) delivers power to the secondary coil 260 of the ignition coil 300. When the voltage across the secondary coil 260 exceeds the breakdown voltage between the electrodes of the spark plug 206, an initial discharge of a high voltage occurs between the electrodes. In this embodiment, the first and second sub-circuits have been replaced by diodes D1 and D2.

The initial voltage discharged across the spark plug 206 may be in the range of 500 V. Thus, the diode D1 should be able to sustain a voltage drop across it of close to 500 V. However, 500 V is given by way of example only and as one of ordinary skill in the art will readily realize, this voltage could be higher or lower depending upon the application.

The initial high voltage serves several functions. First, this high voltage may help knock loose any carbon and/or metal deposits present between the electrodes of the spark plug 206. In addition, this high voltage may also begin forming the plasma kernel.

During the time that the primary circuit is charging the coil 300, the power supply 224 is charging capacitors C3 and C2. The diode D2 keeps the secondary coil 260 from discharging through either capacitor C3 or capacitor C2.

After the initial discharge of the secondary coil 260 through the spark plug 206, both capacitors C2 and C3 begin to discharge through the spark plug 206. The discharge of capacitor C3 is a fast discharge as compared to the discharge of capacitor C2 due to the inductor L1 placed between the two. Thus, capacitor C3 provides a fast, high current discharge through spark plug 206 which serves to cause the plasma kernel between the electrodes of the spark plug 206 to expand and travel outwardly between the electrodes. Due to the inductor L1, the discharge of capacitor C2 is slower than that of capacitor C3 and sustains a current between the electrode even after capacitor C3 has discharged. Capacitor C2 is prevented from discharging through, and thereby charging, capacitor C3 by blocking diode D3.

Figure 19:
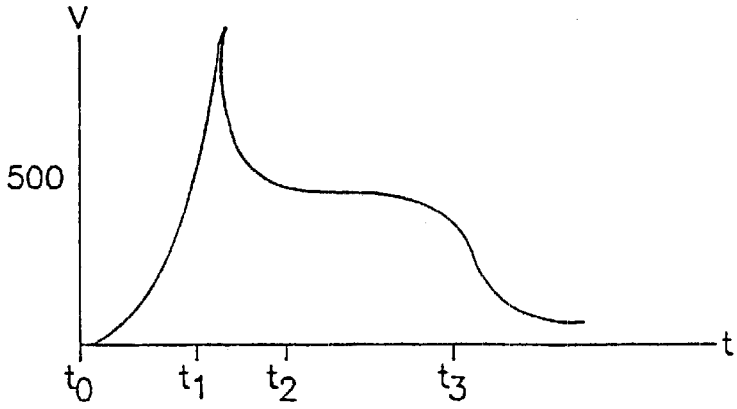
FIG. 19 is a graph representing an example of the voltage between the electrodes of a spark plug with respect to time that may be created by the circuit of FIG. 18.

FIG. 19 is a graph of voltage across the electrodes of the spark plug 206 as a function of time. From time $t_0$ to time $t_1$ the voltage across the electrodes of the spark plug 206 rises as the voltage across the secondary coil 260 increases until time $t_1$. At time $t_1$, the voltage has increased to a level where a breakdown can occur between the electrodes of the spark plug 206. In addition, because there is no inductor between capacitor C3 and the spark plug, capacitor C3 also begins to discharge which adds to the current through the spark plug and lead to "the snap" across the electrodes. Both the secondary coil 260 and capacitor C3 are allowed to discharge freely. Thus, the voltage drops quickly between time $t_1$ and $t_2$ At time $t_2$, capacitor C2 (whose discharge was delayed by inductor L1) begins to discharge through the spark plug 206. The combined discharges of the secondary winding 260 and of capacitors C2 and C3 accounts for the flatness of the voltage curve between times $t_2$ and $t_3$. By time $t_3$, capacitor C3 and the secondary winding 260 have fully discharged and capacitor C2 is allowed to discharge on its own and provide a current through the plasma between the electrode for an extended time period (i.e., until it fully discharges or a new cycle begins).

Suitable values for the components of the circuit in FIG. 18 have been found to be C2=2 $\mu$F, C3=0.2 $\mu$F, L1=200 $\mu$H, and R1=2 K ohms with the power supply 224 providing 500 V.

It should be understood that the preceding functional explanation may apply to any of the three stage circuits described herein.

Figure 20:
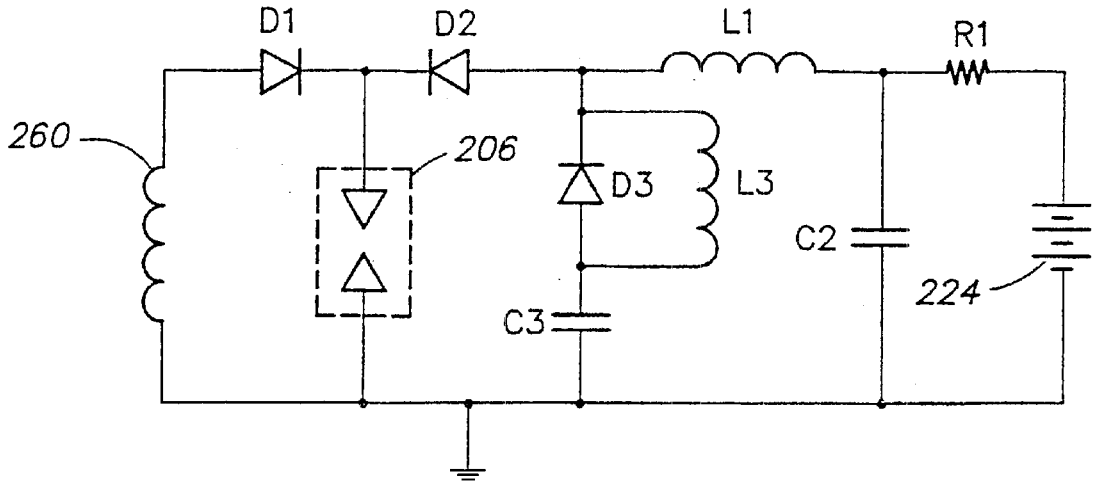
FIG. 20 is an alternative to the secondary circuit shown in FIG. 18.

FIG. 20 shows another embodiment of a secondary circuit 208. This embodiment is substantially the same as the one discussed in relation to FIG. 18 with the addition of the third sub-circuit SC3. In this example, the third sub-circuit SC3 includes a diode D3 connected in parallel with an inductor L3. The cathode of the diode D3 is connected between D2 and L1 and its anode is connected to the capacitor C3. C1 has been omitted for clarity but may be included as one of ordinary skill will readily realize.

Figure 21:
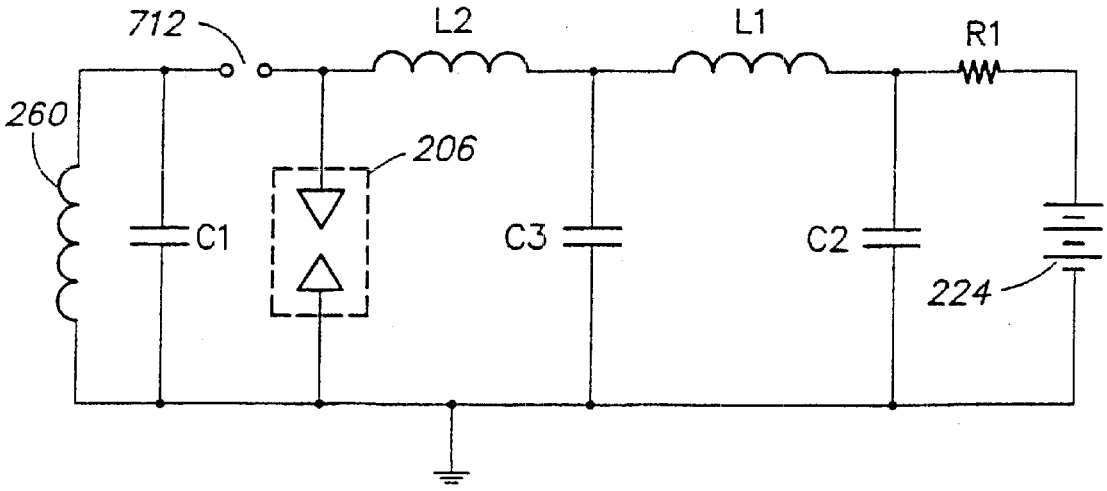
FIG. 21 is another alternative to the secondary circuit shown in FIG. 18.

FIG. 21 shows a circuit similar to that of FIG. 18 except that diodes D1 and D2 have been replaced, respectively, by a spark gap 712 and inductor L2. This embodiment functions in much the same manner as FIG. 18. The spark gap 712 and inductor L2 provide the same functionality as the diodes D1 and D2 which they replace albeit in a different manner. The spark gap 712 provides an impedance so that C3 and C2 do not discharge in to the secondary coil 260 or charge C1 instead of the spark plug 206 and inductor L2 provides a similar impedance to keep the voltage from the secondary coil 260 from charging capacitors C2 and C3 instead of discharging across the electrodes of the spark plug 206. The inductor L2 provides this functionality due to inherent characteristics of inductors as well as the characteristic frequency of the break down across the spark gap 712. The inductor L2 should be sized such that it provides a high enough impedance at the characteristic frequency of the air gap breakdown (about 10 MHz) while still allowing both C3 and C2 to discharge through L2. In some embodiments, the spark gap 712 may be replace by solid-state elements that operate in manners similar to a spark gap such as a break-over diode or a self-triggered SCR. In other respects the multi-stage discharge is the same as described above.

Figure 22:
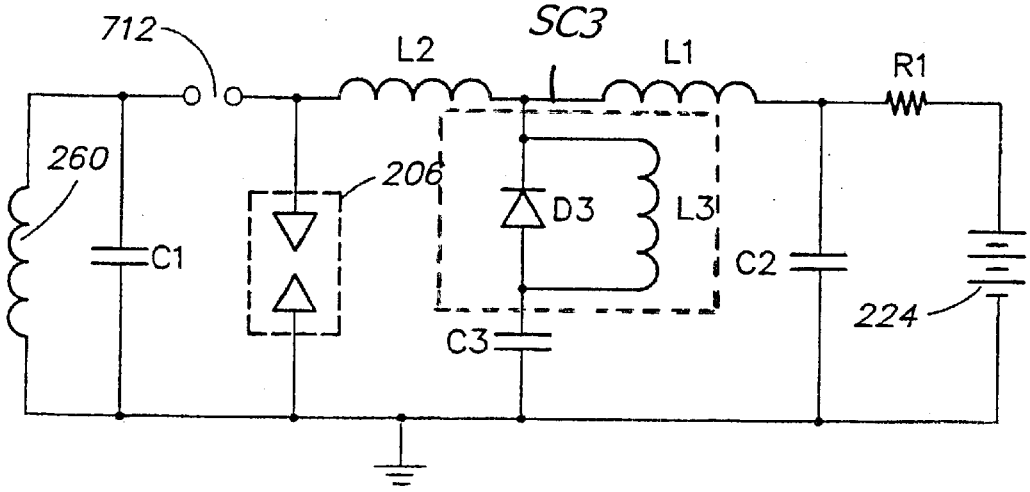
FIG. 22 is a variation of the circuit shown in FIG. 21.

Of course, and as shown in FIG. 22, the secondary circuit could include the third sub-circuit SC3 described above. In the embodiment of FIG. 22, the third sub-circuit SC3 includes a diode D3 connected in parallel with an inductor L3 where the cathode of diode D3 is connected between D2 and L1 and its anode is connected to the capacitor C3. Of course, SC3 could just include diode D3.

Figure 23:
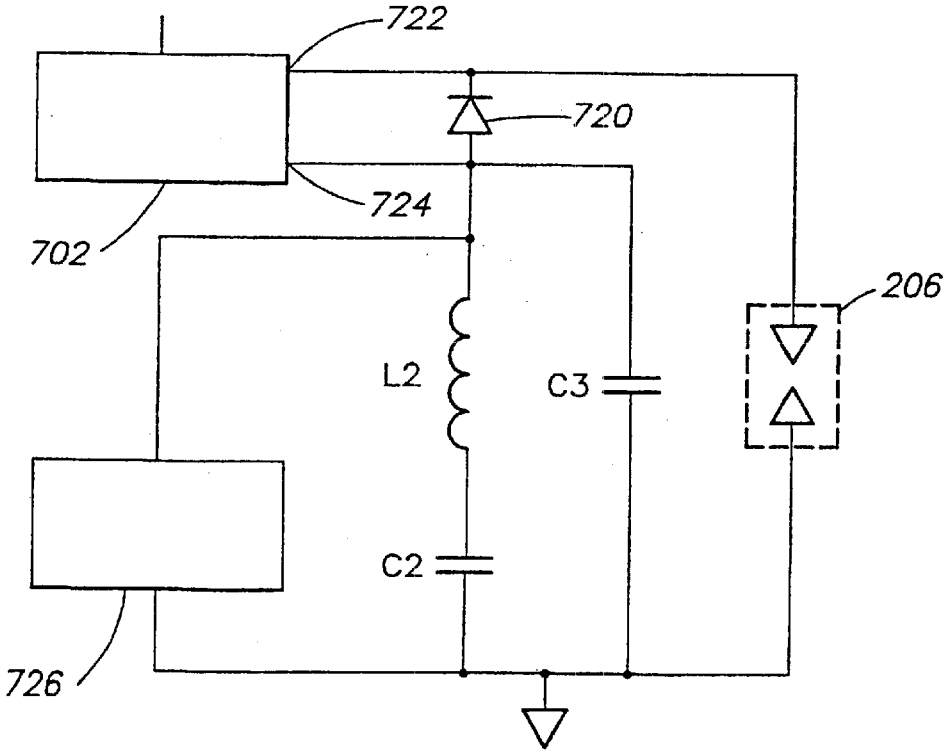
FIG. 23 is series connected version of the circuit disclosed in FIG. 17.

FIG. 23 is an alternative embodiment of a circuit which provides a three stage discharge through the spark plug 206. In this embodiment, a conventional high-voltage circuit 702 may be connected directly to the spark plug 206. The blocking diode 720 is connected between the output terminals 722 and 724 of the high voltage circuit 702 and serves to keep the high voltage circuit from charging capacitors C2 and C3. Capacitor C3 is connected between the anode of the blocking diode 720 and ground. Connected in parallel with capacitor C3 is the series connection of inductor L1 and capacitor C3. After the initial break down between the electrodes of the spark plug 206 caused by the high voltage of the conventional high-voltage circuit 702, as described above, C3 quickly discharges through the spark plug 206 while the discharge of C2 is slowed by inductor L1. The discharge in this embodiment is similar to that disclosed in FIG. 19. Of course, and as discussed above, the circuit of FIG. 23 also includes a charging circuit 726 to charge capacitors C2 and C3 before each discharge.

Figure 24:
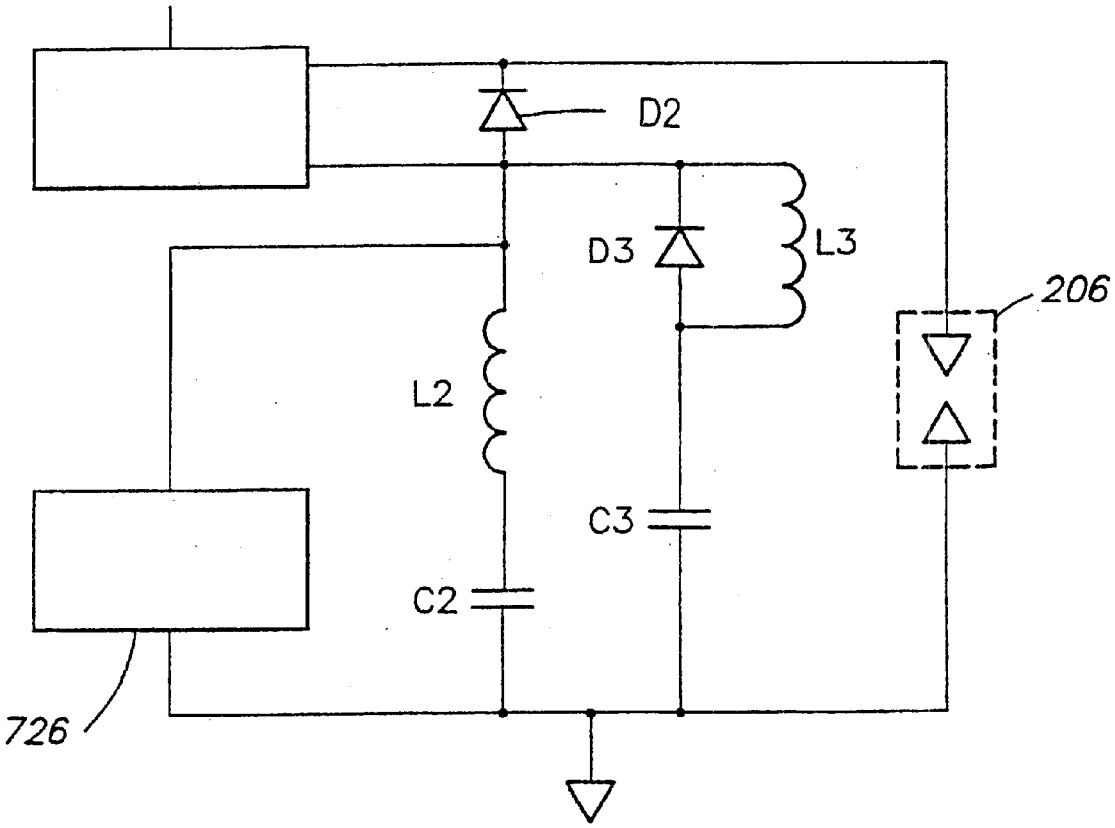
FIG. 24 is a variation of the circuit shown in FIG. 23.

FIG. 24 shows an embodiment similar to that shown in FIG. 23 with the addition of the third sub-circuit SC3. In this embodiment, includes a diode D3 connected in parallel with an inductor L3 where the cathode of diode D3 connected between D2 and L1 and its anode is connected to the capacitor C3.

Figure 25:
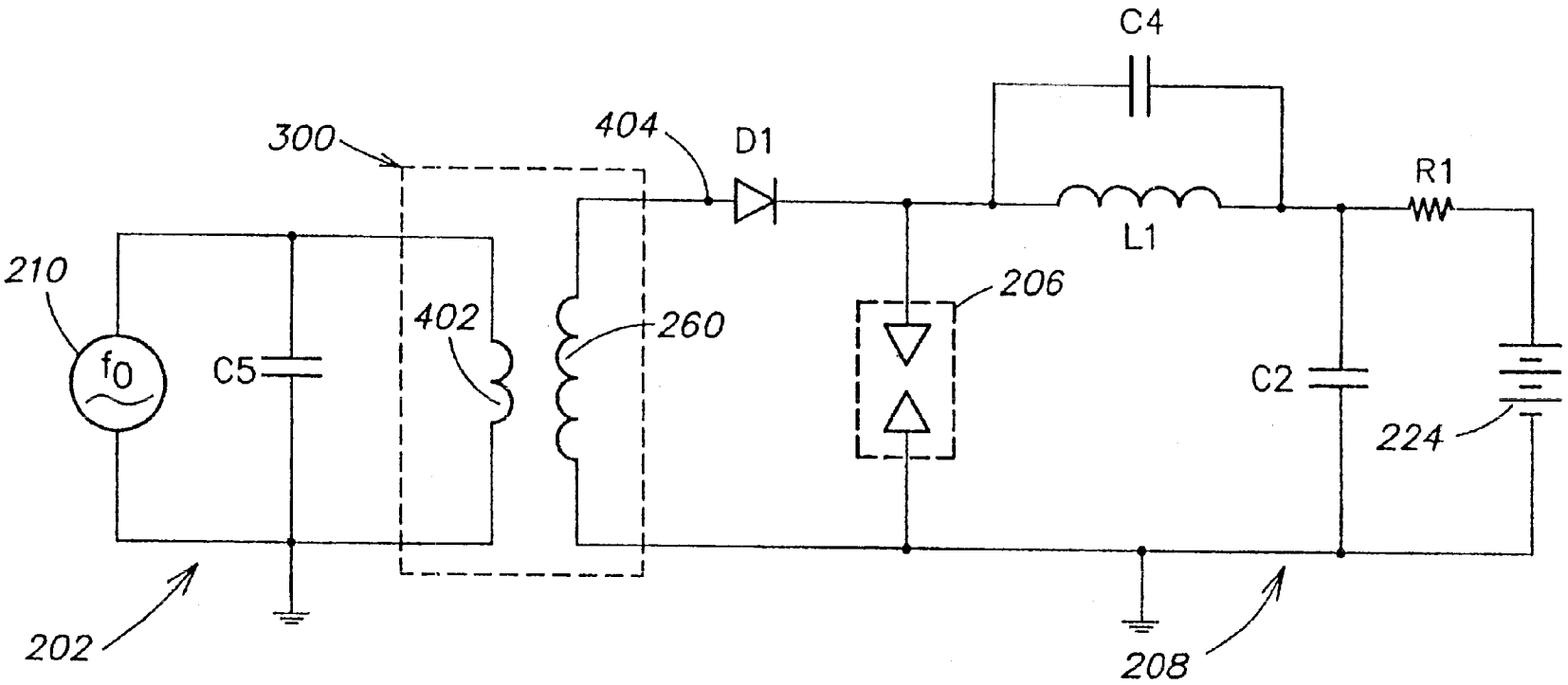
FIG. 25 is another variation of the firing circuitry of the present invention.

FIG. 25 is an example of another embodiment of a secondary circuit 208 according to the present invention. This embodiment differs from the prior embodiments in at least two respects. First, this embodiment does not utilize a spark gap or diode in order to prevent the capacitor C2 of the secondary circuit 208 from being charged by the voltage across the secondary winding 260 of the ignition coil 300. Second, the power supply 210 of the primary circuit 202 supplies an oscillating voltage. In one embodiment, power supply 210 may oscillate at an RF frequency.

The ignition coil 300 in this case has a primary winding 402 which has fewer turns than the secondary winding 260. In a preferred embodiment, the secondary winding 260 of the ignition coil 300 has a self-resonance approximately equal to the oscillation frequency $f_0$ of the oscillating power supply 210. Because the primary winding 402 of the ignition coil 300 has fewer turns than the secondary winding, its resonant frequency does not match that of the oscillating power supply 210. As such, an appropriately sized capacitor C5 is used to tune the primary winding 402 to the resonant frequency of the oscillating power supply 210. Thus, at node 404 there exists an oscillating high voltage. The diode D1, as discussed above, prevents the discharge of capacitor C2 into the secondary winding 260. The diode D1 also serves as a half-wave rectifier. As one of ordinary skill in the art would readily realize, however, the diode D1 could be replaced with a capacitor which will pass the fall oscillating signal while still blocking the DC discharge from capacitor C2.

In contrast to the prior embodiments discussed above, the voltage across winding 260 is prevented from discharging into capacitor C2 by the parallel connection of inductor L1 and capacitor C4 instead of by a diode. The inductor L1 preferably has a high Q factor which allows it to provide, theoretically, infinite impedance at its resonant frequency. Capacitor C4 is used to tune inductor L1 so that its resonant frequency matches that of the oscillating power supply 210. In this manner, the oscillating voltage is prevented from passing through to the capacitor C2.

As discussed above, when the voltage at node 404 exceeds the breakdown voltage across the electrodes of the spark plug 206, the secondary winding 260 is discharged through the electrodes of the spark plug 206. Then capacitor C2 provides the follow-on current which causes the plasma kernel to expand and be expelled from between the electrodes of the spark plug 206. The parallel combination of capacitor C4 and inductor L1 does not affect the discharge of capacitor C2 because this discharge is at a lower frequency.

Figure 26:
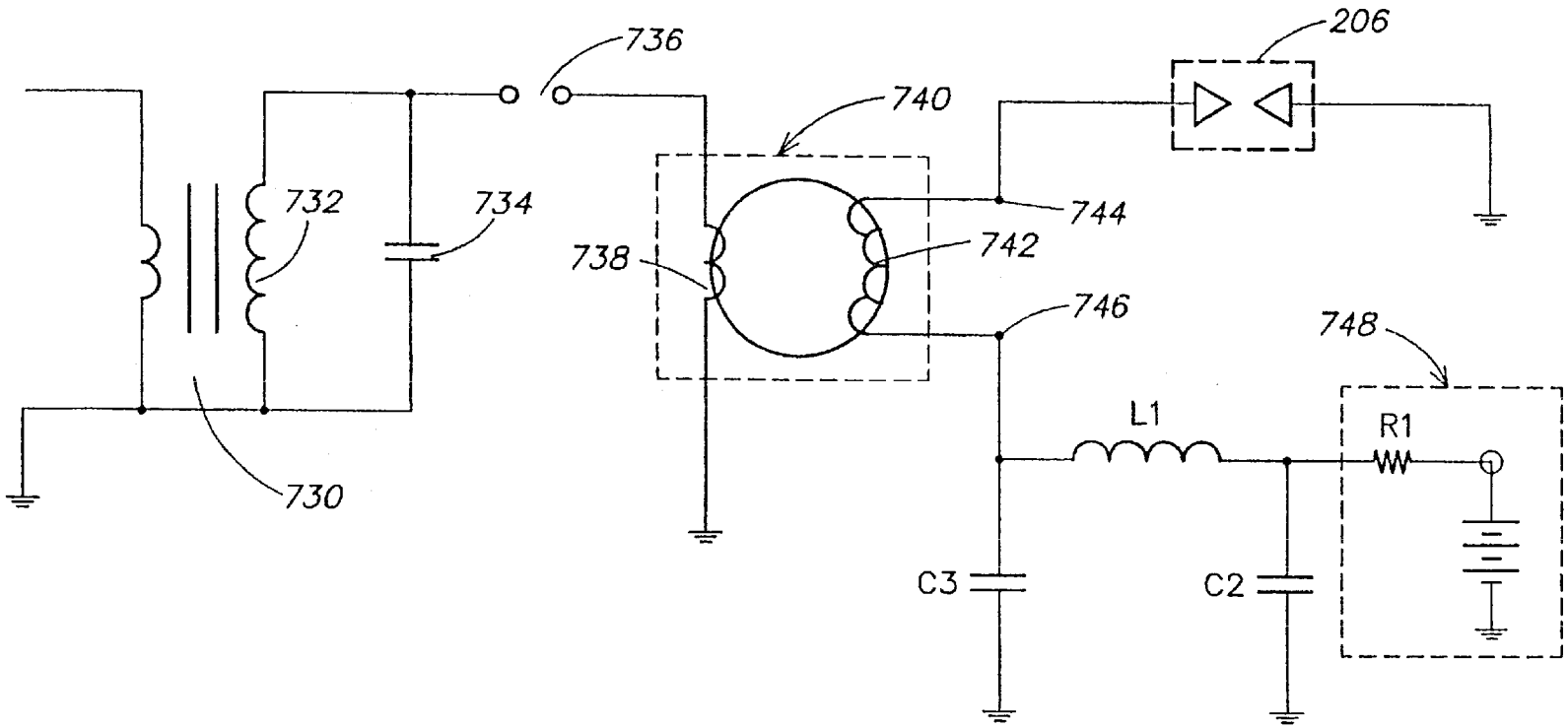
FIG. 26 is yet another embodiment of the firing circuitry of the present invention.

FIG. 26 shows another alternative embodiment circuitry that may be used to provide a multi-stage discharge to a plasma-expelling device. This embodiment includes a first transformer 730 which is typically part of a high-voltage ignition system. Connected to and in parallel with the secondary side 732 of the first transformer 730 is a peaking capacitor 734. The peaking capacitor 734 is connected in parallel with the series connection of a spark gap 736 and the primary side 738 of a second transformer 740. In one embodiment, the second transformer 740 is a torodial transformer (e.g., metal core) having a greater number of turns on its secondary side 742 than on the primary side 738 (e.g., a turns ratio of 4 to 1 may be appropriate).

When a sufficient voltage is stored in the peaking capacitor 734, a rapid breakdown across the spark gap 736 may occur. The rapid breakdown induces a high voltage in the secondary side 742 of the second transformer 740. The high voltage induced in the secondary side 742 causes the initial breakdown between electrodes of the spark plug 206 which is connected between the a first terminal 744 of the secondary side 742 and ground.

Connected between the second terminal 746 of the secondary side 748 and ground is a the third capacitor C3. The third capacitor C3 is connected in parallel to the series combination of inductor L1 and capacitor C2. A charging circuit 748 may be connected to a point between inductor L1 and capacitor C2 to charge capacitors C2 and C3 (such a charging circuit, as discussed above, may include a power source and a resistor, the resistor being connected to the point between inductor L1 and capacitor C2).

After the initial breakdown between the electrode of the spark plug 206, capacitors C3 and C2 begin to discharge (e.g., current begins to flow from) through secondary side 742 of the second transformer 742 to the spark plug 206. The current through the secondary side 742 causes the core of the second transformer 740 to saturate and thereby reduces the effective impedance of the secondary side 742. As before, the inductor L1 slows the discharge of capacitor C2 to create an discharge through the spark plug 206 similar to that shown in FIG. 19. In one embodiment, the first and second sides, 732 and 742, respectively, should be phased such the at the induced current in the secondary side 742 due to the initial breakdown flows in the same direction as the discharge from capacitors C2 and C3. This avoids having to reverse the magnetic field in the core and thereby avoids losses associated with such a reversal.

Examples of values of components described in relation to FIG. 26 are C1=200 pF, C2=2.2 $\mu$F, C3=0.67 $\mu$F and L1=200 $\mu$F.

IV. Add-On Units

Any of the above described secondary circuit embodiments may be implemented as an add-on unit to be used in conjunction with a conventional ignition system installed on an internal combustion engine in order to allow such engines to operate a plasma-generating device in an effective manner. For example, and referring now to FIG. 27, the secondary circuit 208 could be totally encapsulated in a small package which is connected to the output of the primary electronics (circuit) 202 (which could be any conventional ignition system and, as shown, includes the ignition coil 300). In one embodiment, the add-on unit includes the two diodes D1 and D2 or alternatively, spark gaps discussed above could be provided in their place. Between the cathodes of diodes D1 and D2 is the spark plug 206. The follow-on current producer 602 may contain any of the above described secondary circuits as viewed from the right of the blocking element D2. It should be appreciated that D2 may be replaced by the parallel LC combination disclosed above if the primary electronics utilize an alternating voltage source. Furthermore, the power supply 224 could be co-located or receive power from the power source of the primary electronics.

In one embodiment, the secondary electronics 208 may be turned off to allow the primary electronics only to control the spark plug. This may be advantageous for some engine operating conditions. For example, when the engine is running at high RPM's due to the fuel/air mixing provided by a carburetor at these speeds. Thus, the switch 604 may open when it is determined that the engine is operating at high enough RPM's to have a good mixture and a follow-on voltage is not needed to create a larger plasma kernel.

V. Placement of a Plasma-Generating Device in a Combustion Chamber

Figure 27:
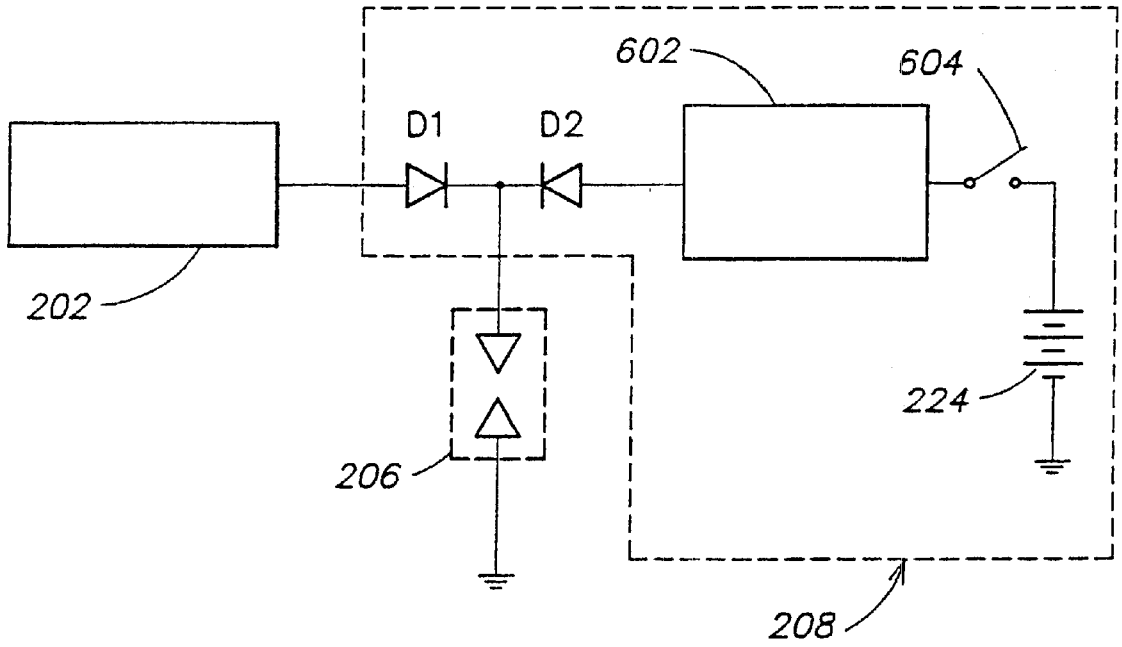
FIG. 27 shows the secondary electronics as included in an add-on unit to be used in combination with a conventional ignition system.

Optimal placement of an ignitor will be discussed in relation to FIGS. 26–27 below. Generally, when operating on systems containing stratified mixtures, the ignitor should be mounted in the combustion chamber so that it does not contact the fuel plume introduced into the combustion chamber, but rather, expels the plasma into the fuel plume from a distance.

Figure 28:
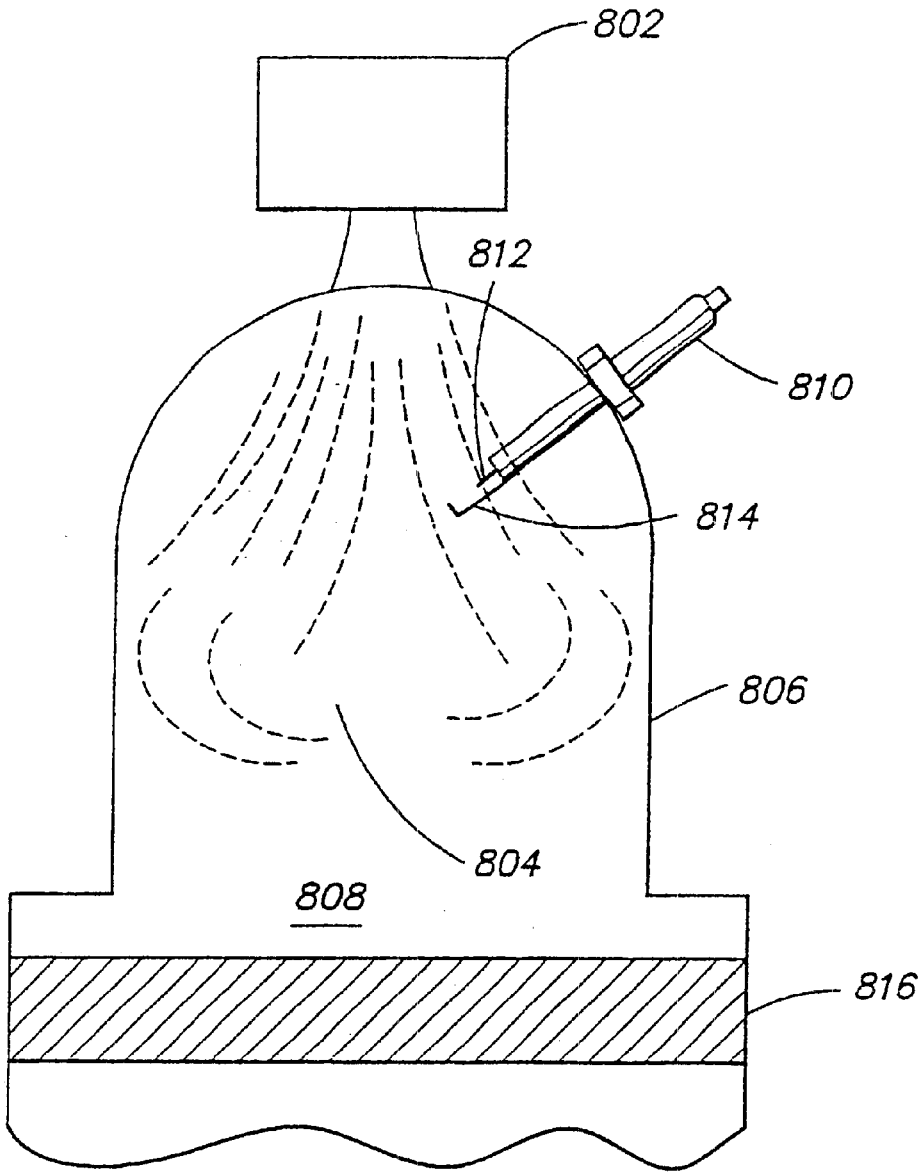
FIG. 28 shows how a conventional spark plug may be placed in a combustion chamber.

FIG. 28 is an example of a conventional ignition setup for an internal combustion engine. A fuel injector 802 periodically injects a fuel plume 804 into a combustion chamber 806. After the fuel plume 804 has been injected, the combustion chamber 806 contains a stratified mixture having a fuel rich region (the fuel plume 804) and a region without a 808 substantial amount of fuel. A spark plug such as conventional spark plug 810 ignites the fuel plume 804 by creating an electrical discharge (spark) between the first electrode 812 and a second electrode 814. The spark causes the fuel plume 804 to ignite and drive the piston 816 in the downward direction.

As discussed above, there are several problems associated with such a system. Namely, the location of the fuel plume 804 must be directed such that there is a minimum amount of fuel near the walls of the combustion chamber 806 in order to avoid quenching of the flame by the walls of the combustion chamber 806. In addition, the discharge between the first and second electrodes 812 and 814 must be positioned so that it contacts the fuel plume 804 or the fuel plume 804 may fail to ignite. Placing the electrodes 812 and 814 directly in the path of the fuel plume 804 may lead to the spark being blown out by passing fuel or create a significant amount of fouling of the plug 810.

Figure 29:
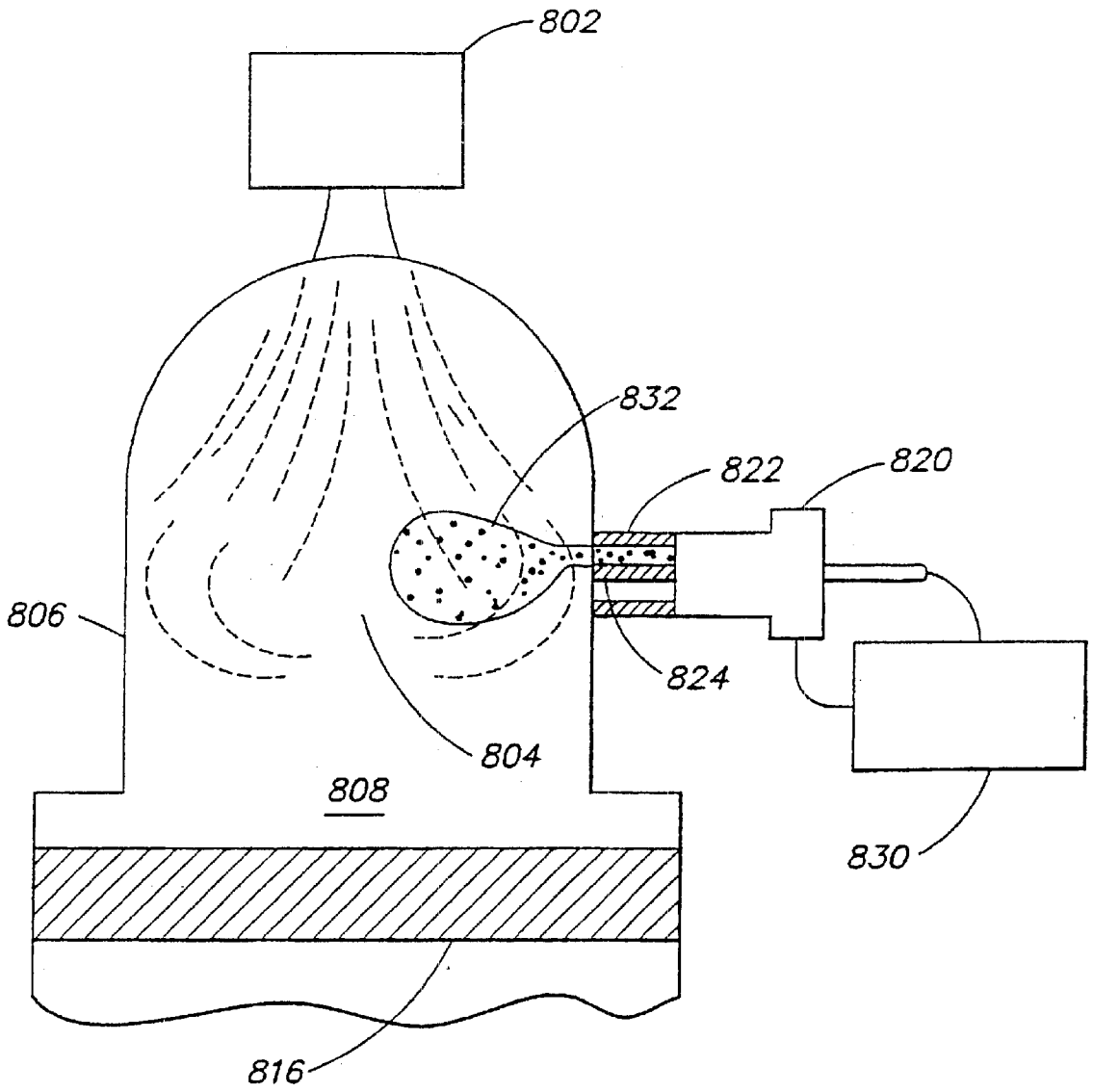
FIG. 29 shows how embodiments of the present invention may be placed in a combustion chamber.

FIG. 29 illustrates by example a way to avoid these problems utilizing the teachings contained herein. As before, the fuel injector 802 injects a stratified mixture (i.e., a fuel plume 804) into the combustion chamber 806. Thus, the combustion chamber 806 includes a stratified mixture of the fuel plume 804 and a region 808 that does not contain a significant amount of fuel. It should be appreciated that the fuel injector may introduce the fuel plume 804 into the combustion chamber 806 by a variety of methods, such as direct fuel injection.

A plasma-generating device 820 is displaced in the combustion chamber so that the ends of its electrodes 822 and 824 are flush or nearly flush with the wall of the combustion chamber 106. In one embodiment, the end of the longer electrode 822 or 824 extends less than about 2.54 cm (1 inch) into the combustion chamber 806. In other embodiments, the electrodes may extend from any distance between about 0 and 2.54 cm into the combustion chamber 806. The plasma-generating device 820 generates a volume of plasma 832, as described above, which is expelled from between the electrodes 822 and 824 into the fuel plume 804 and ignites the fuel plume 804. Such a system allows the ignition system designer to integrate a plasma-generating device that is flush or nearly flush with an optimized combustion chamber. Instead of extending the spark plug reach (and incurring many of the aforementioned problems) into the fuel plume 804, one embodiment of the present invention uses a combination of special dual-energy electronics 830 (as described above) and an appropriately designed plasma-generating device to form a plasma 832 and inject it into the fuel plume 804.

At high speeds, engines are generally run in a homogenous mixture mode of operation where the fuel injector injects the fuel plume 804 into the combustion chamber 806 early in the cycle to provide a uniform mixture throughout the combustion chamber 806, when combustion initiates near top dead center of the engine cycle. The ignition system of the present invention proves advantageous in this mode as well. First, the plasma-generating device 820 may be flush or nearly flush with the cylinder wall, which reduces hydrocarbon emissions and partial burn that result from flame quenching around protruding sparkplugs. Secondly, the plasma-generating device 820 is by design a "cold" spark plug, eliminating potential pre-ignition problems resulting from protruding plug designs used in stratified mixture engines today. Third, the present invention allows the combustion chamber to be designed more optimally for performance at higher speed.

Finally, the present invention, in some embodiments, may be operated in a conventional mode (as opposed to the dual-stage mode discussed above). In these embodiment, the system may include a disabling element (either external or built-in; possibly inherent to the electronics) for controlling the application of TSI operation vs. conventional operation, according to which areas of operation require a higher-energy ignition kernel. The disabling element serves to disable the follow-on current provider (e.g., secondary electronics) or, alternatively, to prevent the current generated in the provider from discharging through the ignitor. In either case, the net effect is to prevent the follow-on current from being transmitted to the ignitor.

The system may switch modes based upon engine RPM, throttle position, the rate at which the RPM's are changing, or any other available engine condition that may give insight to how well the fuel is mixed. One simple way to implement such a system includes, as referring back to FIG. 27 by way of example only, including an additional element (such as a thyristor) between the portion of the circuit which generates the follow on current (e.g., to the left of D2) which only allows the follow on portion to be provide when the element is active. Such an element, in effect, blocks the current from the follow-on current provider. Alternatively, and as discussed above, the switch 604 could serve to disconnect the follow on current producer when such a follow on current is not needed. Either the switch 604 or the additional element, as one will readily realize, may be controlled by a circuit which determines the best mode of operation depending upon the operating conditions discussed above, as well as others.

Having now described a few embodiments, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention.

What is claimed is:

1. A plasma-generating device comprising:

at least two spaced apart electrodes having a discharge gap between them; and an electrically insulating material filling a substantial portion of the space between the electrodes, the electrically insulating material having an upper surface which does not extend across the entire distance between the electrodes;

wherein the electrodes are dimensioned and configured and their spacing is arranged such that, when sufficiently high first voltage is applied between the electrodes, a plasma is formed between the electrodes at an initiation region, a Lorentz force is created by the current in at least one electrode, and the plasma moves outward along the electrodes and away from the initiation region under at least this Lorentz force;

wherein at least a portion of the initiation region is located on at least a portion of the upper surface.

2. The device of claim 1, wherein the electrodes are dimensioned and configured and their spacing is arranged such that the length of at least one of the electrodes is relatively short with respect to the discharge gap width and wherein the width of the discharge gap is defined by the distance between said electrodes at the discharge initiation region and the length of the discharge gap is defined by the distance from the discharge initiation region to the end of the shortest electrode.

3. The device of claim 1, wherein the minimum length of said electrodes of the discharge gap is such that it allows the plasma to move along the electrodes away from the initiation region under the effect of said Lorentz force.

4. The device of claim 2, wherein the discharge gap length is greater or equal to ⅓ of the discharge gap width.

5. The device of claim 2, wherein the discharge gap width is greater than ⅓ of the discharge gap length.

6. The device of claim 2, wherein the discharge gap width is greater than ½ of the discharge gap length.

7. The device of claim 1, wherein the surface of the electrically insulating material extends more than one-half of the distance between the said electrodes.

8. The device of claim 1, wherein the said electrodes of the discharge gap are approximately parallel to one another.

9. The device of claim 1, wherein the said electrodes of the discharge gap are cylinders.

10. The device of claim 9, wherein the said electrodes are concentric.

11. The device of claim 10, wherein the outer electrode has portions removed therefrom.

12. The device of claim 1, wherein at least one of the electrodes is a planar surface.

13. The device of claim 1, wherein the discharge surfaces of the electrodes are substantially parallel to one another from a location that is at least one half of a width of the discharge gap below the upper surface of the electrically insulating material to an end of the shortest of the said electrodes.

14. The device of claim 1, further comprising a third electrode disposed between the first and second electrodes.

15. The device of claim 1 wherein the said surface of the electrically insulating material is not in contact with any of the electrodes.

16. The device of claim 1, further comprising means for attaching the said device to the electrical circuit via a coaxial connection.

17. The device of claim 1, wherein at least a portion of at least one of the electrodes is formed of a magnetic material.

18. The device of claim 1, wherein the gap in the said surface of the electrically insulating material is located in the region away from any of the electrodes.

19. The device of claim 1 for use as an ignitor.

20. The device of claim 19, further comprising means for mounting the ignitor in an engine.

21. A plasma-generating system comprising:

a plasma generating device; and an electrical circuit;

the plasma generating device including:

at least two spaced apart electrodes having a discharge gap between them; and an electrically insulating material filling a substantial portion of the space between the electrodes, the electrically insulating material having an upper surface which does not extend across the entire distance between the electrodes, wherein at least a portion of the upper surface defines a plasma initiation region, said plasma being formed upon application of a sufficient voltage from the electrical circuit between electrodes;

wherein the electrodes are dimensioned and configured and their spacing is arranged such that when a plasma is formed between the electrodes at the initiation region, a Lorentz force is created by a current in at least one electrode, and the plasma moves outward along the electrodes and away from the initiation region under at least the Lorentz force;

wherein the electrical circuit generates at least one pulse sufficient to create plasma between said electrodes and to generate said Lorentz force acting on the plasma.

22. The system of claim 21, wherein the electrodes are dimensioned and configured and their spacing is arranged such that the length of at least one of the electrodes is relatively short with respect to the discharge gap width and wherein the width of the discharge gap is defined by the distance between said electrodes at the discharge initiation region and the length of the discharge gap is defined by the distance from the discharge initiation region to the end of the shortest electrode.

23. The system of claim 22, wherein the minimum length of said electrodes of the discharge gap is such that it allows the plasma to move along the electrodes away from the initiation region under the effect of a Lorentz force.

24. The system of claim 22, wherein the discharge gap length is greater or equal to ⅓ of the discharge gap width.

25. The system of claim 22, wherein the discharge gap width is greater than ⅓ of the discharge gap length.

26. The system of claim 22, wherein the discharge gap width is greater than ½ of the discharge gap length.

27. The system of claim 21, wherein the surface of the electrically insulating material extends more than one-half of distance between the said electrodes.

28. The system of claim 21, wherein the said electrodes of the discharge gap are approximately parallel to one another.

29. The system of claim 21, wherein the said electrodes of the discharge gap are cylinders.

30. The system of claim 29, wherein the said electrodes are concentric.

31. The system of claim 30, wherein the outer electrode has portions removed therefrom.

32. The system of claim 21, wherein at least one of the electrodes is a planar surface.

33. The system of claim 21, wherein the discharge surfaces of the said electrodes are substantially parallel to one another from a location that is at least one half of a width of the discharge gap below the upper surface of the electrically insulating material to the end of the shortest of the said electrodes.

34. The system of claim 21, further comprising a third electrode disposed between the first and second electrodes.

35. The system of claim 34, wherein the first voltage is applied between the third electrode and the second electrode and the second voltage is applied between the first electrode and the second electrode.

36. The system of claim 21, wherein the said surface of the electrically insulating material is not in contact with any of the electrodes.

37. The system of claim 21, further comprising means for attaching the said device to the electrical means of the system via a coaxial connection.

38. The system of claim 21, wherein at least a portion of at least one of the electrodes is formed of a magnetic material.

39. The system of claim 21, wherein the gap in the said surface of the electrically insulating material is located in the region away from any of the electrodes.

40. The system of claim 21, wherein the plasma generating device is an ignitor and further includes means for mounting the ignitor in an engine.

41. The system of claim 21, wherein the electrical means include an electrical circuit able to provide a rapid rise high current pulse applied between the electrodes following the discharge initiation.

42. The system of claim 34, wherein the electrical means include an electrical circuit able to provide a rapid rise high current pulse applied between the electrodes following the discharge initiation.

43. The system of claim 37, wherein the electrical means include an electrical circuit able to provide a rapid rise high current pulse applied between the electrodes following the discharge initiations.

44. The system of claim 40, wherein the ignition circuitry provides a total energy to the ignitor per discharge is less than about 1 percent of the available energy of the ignited mixture.

45. The system of claim 21, wherein the total energy provided to the plasma generating device is less than about 400 mJ per discharge.

46. The system of claim 40, wherein the air-to-fuel ratio of the combustible mixture is leaner than a stoichiometric mixture.

47. The system of claim 21, wherein the electrical means provides at least two voltages the first voltage applied is of relatively high amplitude and low current with respect to the second voltage.

48. The system of claim 34, wherein the electrical means provides at least two voltages the first voltage applied is of relatively high amplitude and low current with respect to the second voltage.

49. The system of claim 37, wherein the electrical means provides at least two voltages the first voltage applied is of relatively high amplitude and low current with respect to the second voltages.

50. A method of producing a large volume of moving plasma, comprising:

providing a plasma generating device having at least two spaced apart electrodes having a discharge gap between them, and an electrically insulating material filling a substantial portion of the space between the said electrodes, the electrically insulating material having an upper surface which does not extend across the entire distance between the said electrodes and wherein at least a portion of a plasma initiation region located at at least a portion of the said upper surface, and wherein the electrodes are dimensioned and configured and their spacing is arranged such that when a plasma is formed between the electrodes at the initiation region, a Lorentz force is created by the current in at least one electrode, and the plasma moves outward along the electrodes and away from the initiation region under this Lorentz force; and energizing the electrical means to generate at least one electrical pulse sufficient to create a plasma between said electrodes of the ignitor and a Lorentz Force acting onto the plasma sufficient to cause the plasma to move away from the initiation region under at least said Lorentz force.

51. The method of claim 49, wherein the at least one electrical pulse includes a first pulse that is of sufficient amplitude and duration and the electrodes are of sufficient length to cause the plasma to move along the electrodes, away from the initiation region under a Lorentz force.

52. The method of claim 49, including the step of adjusting the amplitude and duration of the high current electrical pulse to control the velocity of the plasma as it transits the discharge gap.

53. The method of claim 49, further including the steps of using the plasma generating device as an ignitor and of mounting the ignitor into a combustion system such that the discharge gap is exposed to the combustion region.

54. The method of claim 49, further including the steps of using the plasma generating device as an ignitor and of mounting the ignitor into a cylinder of an internal combustion engine so that the discharge gap of the ignitor is exposed to the combustion region.

55. The method of claim 49, further including mounting the ignitor to a direct injected engine such that the plasma penetrates the fuel plume under at least one stratified charge condition.

56. The method of claim 49, further including mounting the ignitor to a direct injected engine such that the plasma penetrates the fuel plume under all stratified charge conditions.

57. The method of claim 49, further including mounting the ignitor to a direct injected engine such that the end of the electrodes are flush with the edge of the combustion region.

58. The method of claim 49, further including mounting the ignitor to a direct injected engine such that the ends of the electrodes electrodes are at the edge of a fuel plume in a combustion chamber of the engine.

* * * * *

UNITED STATES PATENT AND TRADEMARK OFFICE

CERTIFICATE OF CORRECTION

PATENT NO. : 6,474,321 B1
DATED : November 5, 2002
INVENTOR(S) : Suckewer et al.

It is certified that error appears in the above-identified patent and that said Letters Patent is hereby corrected as shown below:

Column 2,
Line 33, replace “regular” with -- conventional --.
Line 61, replace “references” with -- requirements --.

Column 3,
Lines 20, 22, 42, 44, 63 and 64, replace “dielectric” with -- electrically insulating --.
Line 36, insert a period after “ablation” and delete “by”.
Lines 52-53, delete “in a combustion hamber of an engine”.
Line 57, replace “of” with -- for --.

Column 4,
Line 4, insert -- resulting -- after “field”.
Line 5, insert -- in at least one electrode -- after “current”.
Lines 5-6, delete “with an electric field from the potential difference between the electrodes to cause” and replace with -- creating a Lorentz force which causes --.
Line 7, replace “outwardly” with -- outward --.
Lines 8-9, delete “under a Lorentz force”.
Line 21, replace “travels by expanding” with -- is propelled --.
Line 26, delete “one embodiment”.

Column 5,
Line 44, replace “field” with -- current --.
Line 55, insert -- discharge gap between -- before “electrodes”.
Line 57, replace “after” with -- as -- and replace “has cooled” with -- cools --.
Line 65, insert -- or both -- after “(EGR)”.

Column 6,
Line 42, insert -- the frame front -- after “proportional to”.
Line 54, delete “unavoidable”.

Column 7,
Lines 17-18, delete “such as a piston chamber of an internal combustion engine”.
Line 38, insert “electrically” after “surface of the”.
Line 52, insert -- the -- after “through” and delete “the” after “plasma”.
Line 54, replace “origin” with -- discharge initiation --.

Column 8,
Lines 49 and 51, insert -- surface -- after “material”.

UNITED STATES PATENT AND TRADEMARK OFFICE

CERTIFICATE OF CORRECTION

PATENT NO. : 6,474,321 B1
DATED : November 5, 2002
INVENTOR(S) : Suckewer et al.

It is certified that error appears in the above-identified patent and that said Letters Patent is hereby corrected as shown below:

Column 9,
Lines 9-11, delete "The temperature is not sufficiently high in the discharge gap to fully ionize all atoms.".
Lines 53, 54, 57, 62 and 67, replace "gap-to-length" with -- Gap width -to-length --.
Line 54, insert -- i.e., $W_{dg}/1_x$ -- after "representation"
Line 56, insert -- discharge gap -- after "TSI".
Lines 58-59, delete "by the Lorentz force".
Line 60, replace "increase" with -- increased heating --.
Line 60, delete "of the sputtering process on the electrodes".

Column 10,
Line 2, replace "gap-to-length" with -- Gap width-to-length --.
Line 37, replace "dominant effect" with -- primary function --.
Line 50, replace "or the like on the conduction" with -- on the surface of insulating --.
Line 57, replace "conduction" with -- discharge --.

Column 11,
Line 25, insert -- by -- after "point".
Line 28, replace "when" with -- where --.
Line 36, replace "ring" with -- region --.

Column 12,
Lines 22, 24, 28, 31, 33, 37 and 41, replace "202" with -- 203 --.
Line 29, replace "dielectric" with -- electrically insulating --.

Column 13,
Lines 40-42, delete "The added insulator material 23 will keep the inner metal of electrodes 25, 26 cooler than electrode 18".
Lines 66-67, delete "Also shown in FIG. 8 is a simplified version of the electronics which may drive a TSI."

Column 14,
Lines 11-12, delete "space between electrodes 104 and 106 at the combustion end of the ignitor 101."
Lines 21-25, delete all lines.
Line 33, replace "dielectric" with -- electrically insulating --.
Line 46, insert -- $W_{dg}$" after "gap".

UNITED STATES PATENT AND TRADEMARK OFFICE

CERTIFICATE OF CORRECTION

PATENT NO. : 6,474,321 B1
DATED : November 5, 2002
INVENTOR(S) : Suckewer et al.

It is certified that error appears in the above-identified patent and that said Letters Patent is hereby corrected as shown below:

Column 16,
Line 7, replace “200” with -- 201 --.

Column 18,
Line 22, replace “124” with -- 224 --.
Line 27, replace “a” with -- of --.
Line 42, insert -- due to the inductor L1 -- after “C1”.
Lines 42-48, delete the entire sentence beginning “The reason that…”.
Line 63, replace “f” with -- F --.

Column 19,
Line 7, replace “SCR 264” with -- diose 622 --.
Line 10, replace “264” with -- 622 --.
Line 62, insert -- discharge -- after “current channel”.
Line 63, replace “dielectric” with -- insulating --.
Line 66, replace “move for a” with -- stay sufficiently --.

Column 20,
Line 10, replace “(e.g.” with -- (i.e. --.
Line 11, replace “dielectric” with -- insulating material --.
Lines 19-20, 21, 31 and 35, replace “secondary” with -- second --.
Line 39, replace “dielectric” with -- electrically insulating material --.

Column 21,
Line 26, delete “snap”.
Line 27, replace “first” with -- fast --.
Line 28, insert -- snap -- after “discharge”.
Line 36, insert -- $SC_1$ and $SC_2$ (FIG. 17) -- after “circuits”.

Column 23,
Line 21, replace “In this” with -- This --.
Line 22, delete the comma after “embodiment”.

UNITED STATES PATENT AND TRADEMARK OFFICE

CERTIFICATE OF CORRECTION

PATENT NO. : 6,474,321 B1
DATED : November 5, 2002
INVENTOR(S) : Suckewer et al.

It is certified that error appears in the above-identified patent and that said Letters Patent is hereby corrected as shown below:

Column 23 (cont'd),
Line 23, insert -- is -- after "D3".

Signed and Sealed this

Fourteenth Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,474,321 B1
APPLICATION NO. : 09/595703
DATED : November 5, 2002
INVENTOR(S) : Suckewer et al.

It is certified that error appears in the above-identified patent and that said Letters Patent is hereby corrected as shown below:

Column 11,
Line 34, replace “thing ring” with --thin region--.

Column 20,
Line 61, replace “bread” with --break--.
Lines 56-57, delete “into the first Capacitor 1”.

Column 23,
Line 24, replace “L1” with --L2--.

Column 24,
Line 57, replace “μF” with --μH--.

Column 29,
Line 39, delete the “s” at the end of the word “initiations”.

Column 30,
Line 27, delete the claim dependency “49” and replace with “50”.
Line 32, delete the claim dependency “49” and replace with “50”.
Line 36, delete the claim dependency “49” and replace with “50”.
Line 40, delete the claim dependency “49” and replace with “50”.
Line 45, delete the claim dependency “49” and replace with “50”.

UNITED STATES PATENT AND TRADEMARK OFFICE

CERTIFICATE OF CORRECTION

PATENT NO. : 6,474,321 B1
APPLICATION NO. : 09/595703
DATED : November 5, 2002
INVENTOR(S) : Suckewer et al.

It is certified that error appears in the above-identified patent and that said Letters Patent is hereby corrected as shown below:

Column 30,
Line 49, delete the claim dependency "49" and replace with "50".
Line 53, delete the claim dependency "49" and replace with "50".
Line 56, delete the claim dependency "49" and replace with "50".

Signed and Sealed this

Third Day of February, 2009

John Doll

JOHN DOLL
*Acting Director of the United States Patent and Trademark Office*